US008552953B2

(12) United States Patent
Shimoshikiryoh et al.

(10) Patent No.: US 8,552,953 B2
(45) Date of Patent: Oct. 8, 2013

(54) DISPLAY DEVICE

(75) Inventors: Fumikazu Shimoshikiryoh, Matsusaka (JP); Masae Kitayama, Tsu (JP); Ikumi Itsumi, Kuwana (JP)

(73) Assignee: Sharp Kabushiki Kaisha, Osaka (JP)

( * ) Notice: Subject to any disclaimer, the term of this patent is extended or adjusted under 35 U.S.C. 154(b) by 1161 days.

(21) Appl. No.: 12/311,366

(22) PCT Filed: Sep. 27, 2007

(86) PCT No.: PCT/JP2007/068845
§ 371 (c)(1),
(2), (4) Date: Jun. 4, 2009

(87) PCT Pub. No.: WO2008/038727
PCT Pub. Date: Apr. 3, 2008

(65) Prior Publication Data

US 2009/0273556 A1 Nov. 5, 2009

(30) Foreign Application Priority Data

Sep. 29, 2006 (JP) ..... 2006-267346

(51) Int. Cl.
*G09G 3/26* (2006.01)

(52) U.S. Cl.
USPC ..... 345/99

(58) Field of Classification Search
USPC ..... 345/99
See application file for complete search history.

(56) References Cited

U.S. PATENT DOCUMENTS

| | | | | |
|---|---|---|---|---|
| 4,345,249 | A | 8/1982 | Togashi | |
| 6,304,242 | B1 * | 10/2001 | Onda | 345/99 |
| 6,642,916 | B1 | 11/2003 | Kodama et al. | |
| 6,724,358 | B2 | 4/2004 | Ban et al. | |
| 6,724,452 | B1 | 4/2004 | Takeda et al. | |
| 6,753,835 | B1 | 6/2004 | Sakai | |
| 6,958,791 | B2 | 10/2005 | Shimoshikiryo | |

(Continued)

FOREIGN PATENT DOCUMENTS

| | | |
|---|---|---|
| DE | EP 1441326 A1 * | 7/2004 |
| EP | 1 441 326 | 7/2004 |

(Continued)

OTHER PUBLICATIONS

International Preliminary Report dated Apr. 30, 2009.

(Continued)

*Primary Examiner* — William Boddie
*Assistant Examiner* — Towfiq Elahi
(74) *Attorney, Agent, or Firm* — Harness, Dickey & Pierce, P.L.C.

(57) ABSTRACT

To make a conventional area grayscale display technique applicable to a driving method that is designed to write data in a vertical blanking interval. A display panel with multiple pixels and a display controller that receives an input video signal and a sync signal and gets an image presented on the display panel are provided. If one horizontal scanning period and one vertical scanning period of the input video signal are represented by 1H and V-Total, respectively, the display controller is able to form one vertical scanning period V-Total of a first period in which one horizontal scanning period of the display panel is 1Ho, which is as long as 1H, and a second period in which one horizontal scanning period of the display panel is 1Hn, which is not as long as 1H.

8 Claims, 15 Drawing Sheets

(56) References Cited

U.S. PATENT DOCUMENTS

| | | | | |
|---|---|---|---|---|
| 2004/0027323 | A1 | 2/2004 | Tanaka et al. | |
| 2005/0030303 | A1* | 2/2005 | Morita et al. | 345/204 |
| 2008/0106657 | A1 | 5/2008 | Kitayama et al. | |
| 2008/0106660 | A1* | 5/2008 | Kitayama et al. | 349/39 |
| 2009/0002585 | A1 | 1/2009 | Shimoshikiryoh et al. | |

FOREIGN PATENT DOCUMENTS

| | | |
|---|---|---|
| JP | 11-30975 | 5/1989 |
| JP | 63-21907 | 11/1994 |
| JP | 08-331486 | 12/1996 |
| JP | 09-212137 | 5/1997 |
| JP | 09-243998 | 9/1997 |
| JP | 11-242225 | 9/1999 |
| JP | 2000-105575 | 4/2000 |
| JP | 2001-265287 | 9/2001 |
| JP | 2004/029506 | 1/2004 |
| JP | 2004-62146 | 2/2004 |
| WO | WO 2006/070829 | 7/2006 |
| WO | WO 2006/098448 | 9/2006 |
| WO | WO 2006/098449 | 9/2006 |

OTHER PUBLICATIONS

Extended Search Report for European patent application No. 07828591 dated Apr. 27, 2010.

* cited by examiner

DISPLAY DEVICE

TECHNICAL FIELD

The present invention relates to a display device and more particularly relates to a liquid crystal display device.

BACKGROUND ART

A liquid crystal display (LCD) is a flat-panel display that has a number of advantageous features including high resolution, drastically reduced thickness and weight, and low power dissipation. The LCD market has been rapidly expanding recently as a result of tremendous improvements in its display performance, significant increases in its productivity, and a noticeable rise in its cost effectiveness over competing technologies.

Among other things, an inplane switching (IPS) mode liquid crystal display device (see Patent Document No. 1) and a multi-domain vertical aligned (MVA) mode liquid crystal display device (see Patent Document No. 2) are often used in liquid crystal TV monitors as a wide viewing angle mode liquid crystal display device that can avoid problems such as a significant decrease in contrast ratio or the inversion of display grayscales, which will happen when the image on the screen is viewed obliquely.

Although the display qualities of LCDs have been further improved nowadays, a viewing angle characteristic problem in a different phase has arisen just recently.

Specifically, the γ characteristic of LCDs would vary with the viewing angle. That is to say, the γ characteristic when an image on the screen is viewed straight is different from the characteristic when it is viewed obliquely. As used herein, the "γ characteristic" refers to the grayscale dependence of display luminance. That is why if the γ characteristic when the image is viewed straight is different from the characteristic when the same image is viewed obliquely, then it means that the grayscale display state changes according to the viewing direction. This is a serious problem particularly when a still picture such as a photo is presented or when a TV program is displayed.

The viewing angle dependence of the γ characteristic is more significant in the MVA mode rather than in the IPS mode. According to the IPS mode, however, it is more difficult to make panels that realize a high contrast ratio when the image on the screen is viewed straight with good productivity rather than in the MVA mode. Taking these circumstances into consideration, it is particularly necessary to reduce the viewing angle dependence of the γ characteristic of MVA mode liquid crystal display devices, among other things.

To overcome such a problem, the applicant of the present application disclosed a liquid crystal display device that can reduce the viewing angle dependence of the γ characteristic (or an excessively high contrast ratio of white portions of an image, among other things) by dividing a single pixel into a number of subpixels, and a method for driving such a device in Patent Document No. 3. Such a display or drive mode will sometimes be referred to herein as "area-grayscale display", "area-grayscale drive", "multi-pixel display" or "multi-pixel drive".

Patent Document No. 3 discloses a liquid crystal display device in which storage capacitors Cs are provided for respective subpixels SP of a single pixel P. In the storage capacitors, the storage capacitor counter electrodes (which are connected to CS bus lines) are electrically independent of each other between the subpixels. And by varying the voltages applied to the storage capacitor counter electrodes (which will be referred to herein as "storage capacitor counter voltages"), mutually different effective voltages can be applied to the respective liquid crystal layers of multiple subpixels by utilizing a capacitance division technique.

Hereinafter, the pixel division structure of the liquid crystal display device 200 disclosed in Patent Document No. 3 will be described with reference to FIG. 18. In this example, the liquid crystal display device is supposed to use a TFT as a switching element.

The pixel 10 is split into a subpixel 10*a* and another subpixel 10*b*. To the subpixels 10*a* and 10*b*, connected are their associated TFTs 16*a* and 16*b* and their associated storage capacitors (CS) 22*a* and 22*b*, respectively. The gate electrodes of the TFTs 16*a* and 16*b* are both connected to the same scan line 12. And the source electrodes of the TFTs 16*a* and 16*b* are connected to the same signal line 14. The storage capacitors 22*a* and 22*b* are connected to their associated storage capacitor lines (CS bus lines) 24*a* and 24*b*, respectively. The storage capacitor 22*a* includes a storage capacitor electrode that is electrically connected to the subpixel electrode 18*a*, a storage capacitor counter electrode that is electrically connected to the storage capacitor line 24*a*, and an insulating layer (not shown) arranged between the electrodes. The storage capacitor 22*b* includes a storage capacitor electrode that is electrically connected to the subpixel electrode 18*b*, a storage capacitor counter electrode that is electrically connected to the storage capacitor line 24*b*, and an insulating layer (not shown) arranged between the electrodes. The respective storage capacitor counter electrodes of the storage capacitors 22*a* and 22*b* are independent of each other and have such a structure as receiving mutually different storage capacitor counter voltages from the storage capacitor lines 24*a* and 24*b*, respectively.

Hereinafter, it will be described with reference to the accompanying drawings on what principle mutually different effective voltages can be applied to the respective liquid crystal layers of the two subpixels 10*a* and 10*b* of the liquid crystal display device 200.

FIG. 19 schematically shows the equivalent circuit of one pixel of the liquid crystal display device 200. In this electrical equivalent circuit, the liquid crystal layers of the subpixels 10*a* and 10*b* are identified by the reference numerals 13*a* and 13*b*, respectively. A liquid crystal capacitor formed by the subpixel electrode 18*a*, the liquid crystal layer 13*a*, and the counter electrode 17 will be identified by Clca. On the other hand, a liquid crystal capacitor formed by the subpixel electrode 18*b*, the liquid crystal layer 13*b*, and the counter electrode 17 will be identified by Clcb. The same counter electrode 17 is shared by these two subpixels 10*a* and 10*b*.

The liquid crystal capacitors Clca and Clcb are supposed to have the same electrostatic capacitance CLC (V). The value of CLC (V) depends on the effective voltages (V) applied to the liquid crystal layers of the respective subpixels 10*a* and 10*b*. Also, the storage capacitors 22*a* and 22*b* that are connected independently of each other to the liquid crystal capacitors of the respective subpixels 10*a* and 10*b* will be identified herein by Ccsa and Ccsb, respectively, which are supposed to have the same electrostatic capacitance CCS.

In the subpixel 10*a*, one electrode of the liquid crystal capacitor Clca and one electrode of the storage capacitor Ccsa are connected to the drain electrode of the TFT 16*a*, which is provided to drive the subpixel 10*a*. The other electrode of the liquid crystal capacitor Clca is connected to the counter electrode. And the other electrode of the storage capacitor Ccsa is connected to the storage capacitor line 24*a*. In the subpixel 10*b*, one electrode of the liquid crystal capacitor Clcb and one electrode of the storage capacitor Ccsb are connected to the drain electrode of the TFT 16*b*, which is provided to drive the subpixel 10*b*. The other electrode of the liquid crystal capacitor Clcb is connected to the counter electrode. And the other electrode of the storage capacitor Ccsb is connected to the storage capacitor line 24*b*. The gate electrodes of the TFTs 16*a* and 16*b* are both connected to the scan line 12 and the source electrodes thereof are both connected to the signal line 14.

Portions (a) through (f) of FIG. 20 schematically show the timings of respective voltages that are applied to drive the liquid crystal display device 200.

Specifically, portion (a) of FIG. 20 shows the voltage waveform Vs of the signal line 14; portion (b) of FIG. 20 shows the voltage waveform Vcsa of the storage capacitor line 24*a*; portion (c) of FIG. 20 shows the voltage waveform Vcsb of the storage capacitor line 24*b*; portion (d) of FIG. 20 shows the voltage waveform Vg of the scan line 12; portion (e) of FIG. 20 shows the voltage waveform Vlca of the pixel electrode 18*a* of the subpixel 10*a*; and portion (f) of FIG. 20 shows the voltage waveform Vlcb of the pixel electrode 18*b* of the subpixel 10*b*. In FIG. 20, the dashed line indicates the voltage waveform COMMON (Vcom) of the counter electrode 17.

Hereinafter, it will be described with reference to portions (a) through (f) of FIG. 20 how the equivalent circuit shown in FIG. 19 operates.

First, at a time T1, the voltage Vg rises from VgL to VgH to turn the TFTs 16*a* and 16*b* ON simultaneously. As a result, the voltage Vs on the signal line 14 is transmitted to the subpixel electrodes 18*a* and 18*b* of the subpixels 10*a* and 10*b* to charge the subpixels 10*a* and 10*b* with the voltage Vs. In the same way, the storage capacitors Csa and Csb of the respective subpixels are also charged with the voltage on the signal line.

Next, at a time T2, the voltage Vg on the scan line 12 falls from VgH to VgL to turn the TFTs 16*a* and 16*b* OFF simultaneously and electrically isolate the subpixels 10*a* and 10*b* and the storage capacitors Csa and Csb from the signal line 14. It should be noted that immediately after that, due to the feedthrough phenomenon caused by a parasitic capacitance of the TFTs 16*a* and 16*b*, for example, the voltages Vlca and Vlcb applied to the respective subpixel electrodes decrease by approximately the same voltage Vd to:

$$Vlca=Vs-Vd$$

$$Vlcb=Vs-Vd$$

respectively. Also, in this case, the voltages Vcsa and Vcsb on the storage capacitor lines are:

$$Vcsa=Vcom-Vad$$

$$Vcsb=Vcom+Vad$$

respectively.

Next, at a time T3, the voltage Vcsa on the storage capacitor line 24*a* connected to the storage capacitor Csa rises from Vcom−Vad to Vcom+Vad and the voltage Vcsb on the storage capacitor line 24*b* connected to the storage capacitor Csb falls from Vcom+Vad to Vcom−Vad. That is to say, these voltages Vcsa and Vcsb both change twice as much as Vad. As the voltages on the storage capacitor lines 24*a* and 24*b* change in this manner, the voltages Vlca and Vlcb applied to the respective subpixel electrodes change into:

$$Vlca=Vs-Vd+2\times Kc\times Vad$$

$$Vlcb=Vs-Vd-2\times Kc\times Vad$$

respectively, where Kc=CCS/(CLC(V)+CCS) and × indicates multiplication.

Next, at a time T4, Vcsa falls from Vcom+Vad to Vcom−Vad and Vcsb rises from Vcom−Vad to Vcom+Vad. That is to say, these voltages Vcsa and Vcsb both change twice as much as Vad again. In this case, Vlca and Vlcb also change from $$Vlca=Vs-Vd+2\times Kc\times Vad$$

$$Vlcb=Vs-Vd-2\times Kc\times Vad$$

into $$Vlca=Vs-Vd$$

$$Vlcb=Vs-Vd$$

respectively.

Next, at a time T5, Vcsa rises from Vcom−Vad to Vcom+Vad and Vcsb falls from Vcom+Vad to Vcom−Vad. That is to say, these voltages Vcsa and Vcsb both change twice as much as Vad again. In this case, Vlca and Vlcb also change from $$Vlca=Vs-Vd$$

$$Vlcb=Vs-Vd$$

into $$Vlca=Vs-Vd+2\times Kc\times Vad$$

$$Vlcb=Vs-Vd-2\times Kc\times Vad$$

respectively.

After that, every time a period of time that is an integral number of times as long as one horizontal scanning period (or one horizontal write period) 1H has passed, the voltages Vcsa, Vcsb, Vlca and Vlcb alternate their levels at the times T4 and T5. Consequently, the effective values of the voltages Vlca and Vlcb applied to the subpixel electrodes become:

$$Vlca=Vs-Vd+Kc\times Vad$$

$$Vlcb=Vs-Vd-Kc\times Vad$$

respectively.

Therefore, the effective voltages V1 and V2 applied to the liquid crystal layers 13*a* and 13*b* of the subpixels 10*a* and 10*b* become:

$$V1=Vlca-Vcom$$

$$V2=Vlcb-Vcom$$

That is to say, $$V1=Vs-Vd+Kc\times Vad-Vcom$$

$$V2=Vs-Vd-Kc\times Vad-Vcom$$

respectively.

As a result, the difference ⊿ V12 (=V1−V2) between the effective voltages applied to the liquid crystal layers 13*a* and 13*b* of the subpixels 10*a* and 10*b* becomes ⊿V12=2×Kc ×Vad (where Kc=CCS/(CLC(V)+CCS)). Thus, mutually different voltages can be applied to the liquid crystal layers 13*a* and 13*b*.

FIG. 21 schematically shows the relation between V1 and V2. As can be seen from FIG. 21, the smaller the V1 value, the bigger ⊿ V12 in the liquid crystal display device 200. Since ⊿ V12 increases as the V1 value decreases in this manner, the excessively high contrast ratio can be reduced, among other things.

However, if the multi-pixel structure disclosed in Patent Document No. 3 were applied to either a high-resolution LCD TV monitor or a big LCD TV monitor, the oscillating voltage would have a shorter period of oscillation as the resolution or the size of the display panel increases. Thus, it would be increasingly difficult (and expensive) to make a circuit for generating the oscillating voltage, the power dissipation would increase too much, or the influence of waveform blunting due to the electrical load impedance of the CS bus lines would be more and more significant. However, if a plurality of electrically independent CS trunks are arranged and connected to the multiple CS bus lines as disclosed in Patent Document No. 4, one period of oscillation of the oscillating voltage applied to the storage capacitor counter electrodes by way of the CS bus line can be extended.

Patent Document No. 1: Japanese Patent Gazette for Opposition No. 63-21907

Patent Document No. 2: Japanese Patent Application Laid-Open Publication No. 11-242225

Patent Document No. 3: Japanese Patent Application Laid-Open Publication No. 2004-62146 (corresponding to U.S. Pat. No. 6,958,791)

Patent Document No. 4: WO 2006/070829 A1

DISCLOSURE OF INVENTION

Problems to be Solved by the Invention

If the arrangement disclosed in Patent Document No. 4 is adopted, however, the waveform (phase) of the CS voltage (oscillating voltage) should be controlled to prevent the display quality from decreasing (e.g., to prevent the presented image from having noticeable bright and dark stripes) due to a disagreement between one period of the oscillating voltage (CS voltage) applied to the CS bus lines and one vertical scanning period. For that purpose, Patent Document No. 4 discloses the following method, for example.

Specifically, in one vertical scanning period V-Total of an input video signal, the CS voltage should have a waveform that oscillates with a constant period $P_A$ (which will be referred to herein as a "first type of waveform") in an effective display period V-Disp (which will also be referred to herein as an "effective scanning period") in which a display operation needs to be performed. But in a vertical blanking interval V-Blank in which no display operation is performed, the CS voltage should have its waveform defined such that the effective value of the CS voltage becomes a predetermined constant value every predetermined number of continuous vertical scanning periods. Such a waveform will be referred to herein as a "second type of waveform". And the predetermined number is at most equal to 20 but is typically four or less. That is to say, by shaping the waveform of the CS voltage in a vertical blanking interval in which there is no need to write data on any pixel, the effective value of the CS voltage is kept constant through the predetermined number of continuous vertical scanning periods with the waveform of the CS voltage kept constant in each effective display period. It should be noted that not every effective display period is the period in which the CS voltage has the first type of waveform and that not every vertical blanking interval is the period in which the CS voltage has the second type of waveform, either.

The CS voltage waveform controlling method disclosed in Patent Document No. 4 supposes that there is no need to write data on any pixel within a vertical blanking interval as described above. That is why if a driving method that is designed to write image data in an effective display period and black data in a vertical blanking interval (such a method is called either a "black insert drive" or a "pseudo-impulse drive") is combined with such a method in order to improve the moving picture display performance of the liquid crystal display device, for example, then not every pixel can have the same phase relation between the timing to write the black data in the vertical blanking interval and the oscillating waveform of the CS voltage. As a result, the image may have a noticeable luminance difference (i.e., a significant difference between its bright and dark portions). Such a problem found by the present inventors will be described in detail later.

In order to overcome the problems described above, the present invention has an object of, first and foremost, making the area grayscale display technique disclosed in Patent Document No. 3 applicable to a driving method that is designed to write data in a vertical blanking interval. Another object of the present invention is to provide a liquid crystal display device and its driving method that can always use the area grayscale display technique of Patent Document No. 3, no matter how long one vertical scanning period or one vertical blanking interval is and what type of driving method is adopted (i.e., whether data needs to be written in a vertical blanking interval or not).

Means for Solving the Problems

A display device according to the present invention includes a display panel with multiple pixels and a display controller that receives an input video signal and a sync signal and gets an image presented on the display panel. If one horizontal scanning period and one vertical scanning period of the input video signal are represented by 1H and V-Total, respectively, the display controller is able to form one vertical scanning period V-Total of a first period in which one horizontal scanning period of the display panel is 1Ho, which is as long as 1H, and a second period (which will also be referred to herein as an "adjustment period") in which one horizontal scanning period of the display panel is 1Hn, which is not as long as 1H.

Another display device according to the present invention includes a display panel with multiple pixels and a display controller that receives an input video signal and a sync signal and gets an image presented on the display panel. If one standard horizontal scanning period and one vertical scanning period to write image data on the display panel are represented by 1H and V-Total, respectively, the display controller is able to form one vertical scanning period V-Total of a first period in which one horizontal scanning period of the display panel is 1Ho, which is as long as 1H, and a second period in which one horizontal scanning period of the display panel is 1Hn, which is not as long as 1H.

In one preferred embodiment, V-total is represented as the sum of an effective display period V-Disp and a vertical blanking interval V-Blank and the second period is included in the vertical blanking interval V-Blank.

In another preferred embodiment, the second period is made up of a number of continuous horizontal scanning periods.

In still another preferred embodiment, the second period is an integral number of times as long as 1Hn.

In yet another preferred embodiment, the pixels are arranged in columns and rows so as to form a matrix pattern. Each pixel includes a liquid crystal layer and a plurality of electrodes for applying a voltage to the liquid crystal layer. Each pixel includes: a first subpixel and a second subpixel, having liquid crystal layers to which mutually different voltages are applicable; and two switching elements that are provided for the first and second subpixels, respectively. Each of the first and second subpixels includes a liquid crystal capacitor formed by a counter electrode and a subpixel electrode that faces the counter electrode through the liquid crystal layer, and a storage capacitor formed by a storage capacitor electrode that is electrically connected to the subpixel electrode, an insulating layer, and a storage capacitor counter electrode that is opposed to the storage capacitor electrode with the insulating layer interposed between them. The counter electrode is a single electrode provided in common for the first and second subpixels, while the storage capacitor counter electrodes of the first and second subpixels are electrically independent of each other. A storage capacitor counter voltage applied to each storage capacitor counter electrode by way of an associated storage capacitor line oscillates in a cycle time that is an integral number of times as long as Ho during the first period included in V-Total but oscillates in a cycle time that is an integral number of times as long as Hn during the second period.

In this particular preferred embodiment, if one vertical scanning period V-Total is represented as the sum of an effective display period V-Disp and a vertical blanking interval V-Blank and if V-Total=m×H and V-Disp=$m_0$×H, then V-Disp=$m_0$×Ho, V-Blank=$m_1$×Ho+$m_2$×Hn and $m_2$×Hn is an integral number of times as long as one cycle time of the storage capacitor counter voltage during the second period.

In a specific preferred embodiment, ($m_0$+$m_1$)×Ho is either an integral or a half-integral number of times as long as one cycle time of the storage capacitor counter voltage during the first period.

In yet another preferred embodiment, the display device further includes a plurality of storage capacitor trunks, which are electrically independent of each other and each of which is electrically connected to an associated one of the storage capacitor counter electrodes of the first and second subpixels of the pixels by way of its associated storage capacitor line. The storage capacitor trunks include an even number L of electrically independent storage capacitor trunks. The storage capacitor counter voltage supplied through each of the storage capacitor trunks to its associated storage capacitor line oscillates in a cycle time that is either K×L or 2×K×L times as long as Ho during the first period, where K is a positive integer and either K×L or 2×K×L is equal to or greater than four, and oscillates in a cycle time that is either K×L or 2×K×L times as long as Hn during the second period.

Effects of the Invention

If one horizontal scanning period and one vertical scanning period of an input video signal are represented by 1H and V-Total, respectively, the display device of the present invention can form one vertical scanning period V-Total of a first period in which one horizontal scanning period of the display panel is 1Ho, which is as long as 1H, and a second period in which one horizontal scanning period of the display panel is 1Hn, which is not as long as 1H. That is why according to the present invention, the area grayscale display technique disclosed in Patent Document No. 3 can be applied to such a driving method that is designed to write data even in a vertical blanking interval. The present invention also provides a liquid crystal display device and its driving method that can always use the area grayscale display technique of Patent Document No. 3, no matter how long one vertical scanning period or one vertical blanking interval is and what type of driving method is adopted (i.e., whether data needs to be written in a vertical blanking interval or not). Optionally, 1H may be a standard horizontal scanning period for writing image data on the display panel, instead of one horizontal scanning period of the input video signal. The present invention is applicable to not only a liquid crystal display device but also any other types of display device to which a line sequential driving method is applied just like a liquid crystal display device.

DESCRIPTION OF REFERENCE NUMERALS

Figure 1:
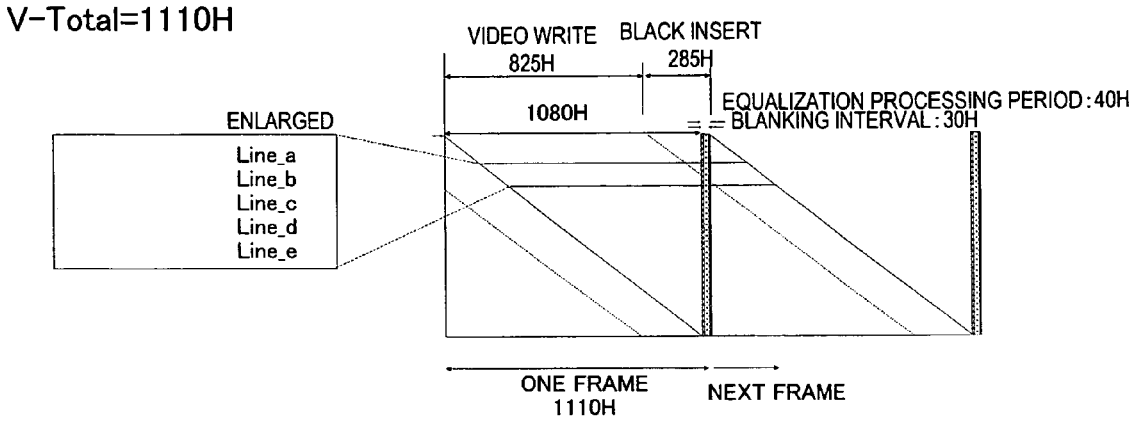
FIG. 1 illustrates what problem will arise if a liquid crystal display device disclosed in Patent Document No. 4 performs a black insert drive operation in a situation where one vertical scanning period V-Total has a length of 1,110H, the effective display period V-Disp thereof has a length of 1,080H and the vertical blanking interval V-Blank thereof has a length of 30 H.

10 pixel
10*a*, 10*b* subpixel
12 scan line (gate bus line)
14*a*, 14*b* signal line (source bus line)
16*a*, 16*b* TFT
18*a*, 18*b* subpixel electrode
50 display section
60 display controller
70 source driver
80 gate driver
90 CS voltage controller
100, 200 liquid crystal display device

BEST MODE FOR CARRYING OUT THE INVENTION

Hereinafter, preferred embodiments of a liquid crystal display device and its driving method according to the present invention will be described with reference to the accompanying drawings. It should be noted that in a liquid crystal display device according to a preferred embodiment of the present invention, the structure of pixels is similar to the one disclosed in Patent Document No. 3, but the connection pattern of storage capacitor lines (which are typically CS bus lines) may be any of the ones disclosed in Patent Document No. 4. The entire disclosure of Patent Documents Nos. 3 and 4 are hereby incorporated by reference.

Hereinafter, the problems with the liquid crystal display device and its driving method as disclosed in Patent Document No. 4 will be described with reference to FIGS. 1 through 4 and FIGS. 5 through 8. As described above, if a driving method that is designed to write image data in an effective display period and black data in a vertical blanking interval is adopted to improve the moving picture display performance of a liquid crystal display device, then not every pixel can have the same phase relation between the timing to write the black data in the vertical blanking interval and the oscillating waveform of the CS voltage. As a result, the image may have a noticeable luminance difference (i.e., a significant difference between its bright and dark portions). Such a problem will be discussed below.

Such a problem is caused by a difference in phase between the timing to write data and the oscillating waveform of the CS voltage. Thus, first of all, it will be described how the oscillating waveform of a CS voltage changes according to the length of one vertical scanning period.

As used herein, one "vertical scanning period V-Total" is defined to be an interval between a point in time when one scan line is selected to write a display signal voltage and a point in time when the same scan line is selected again to write the next display signal voltage. Also, each of one frame period of a non-interlaced drive input video signal and one field period of an interlaced drive input video signal will be referred to herein as "one vertical scanning period V-Total of the input video signal". Normally, one vertical scanning period of a liquid crystal display device corresponds to one vertical scanning period of the input video signal. In the example to be described below, one vertical scanning period is supposed to be one frame period and one vertical scanning period of the liquid crystal display panel is supposed to correspond to that of the input video signal for the sake of simplicity. However, the present invention is in no way limited to that specific preferred embodiment. Alternatively, the present invention is also applicable to a so-called "2×drive" with a vertical scanning frequency of 120 Hz in which two vertical scanning periods of the liquid crystal display panel (that lasts $2\times 1/120$ sec, for example) are allocated to one vertical scanning period of the input video signal (that lasts $1/60$ sec, for example).

One vertical scanning period V-Total of an input video signal is made up of an effective display period V-Disp in which video is presented and a vertical blanking interval V-Blank in which no video is presented. The effective display period for presenting video is determined by the display area (or the number of rows of effective pixels) of an LCD panel. On the other hand, the vertical blanking interval is an interval for signal processing, and therefore, is not always constant but changes from one manufacturer of TV receivers to another. For instance, if the display area has 1,080 rows of pixels, the effective display period is fixed at 1,080× one horizontal scanning period (H) (which will be identified herein by "1,080H"). However, in one case, one vertical blanking interval may be 30H and one vertical scanning period V-Total may be 1,110H. In another case, one vertical blanking interval may be 36H and one vertical scanning period V-Total may be 1,116H. Furthermore, the length of one vertical blanking interval may even alternate between an odd number and an even number every vertical scanning period.

Hereinafter, a situation where one vertical scanning period V-Total is 1,110H, one effective display period V-Disp is 1,080H and one vertical blanking interval V-Blank is 30H will be described with reference to FIGS. 1 through 4. In this case, 1H is supposed to be 14.96 μs (which is approximately equal to 1÷60÷1110).

As shown in FIG. 1, V-Total is supposed to consist of a video write period of 825H and a black insert (or black display) period of 285H. The black insert driving method will be described in detail later. The equalization processing period of 40H shown in FIG. 1 corresponds to a period with the second type of waveform in the CS voltage waveform controlling method disclosed in Patent Document No. 4. In this example, however, the second type of waveform is not necessary.

Figure 2:
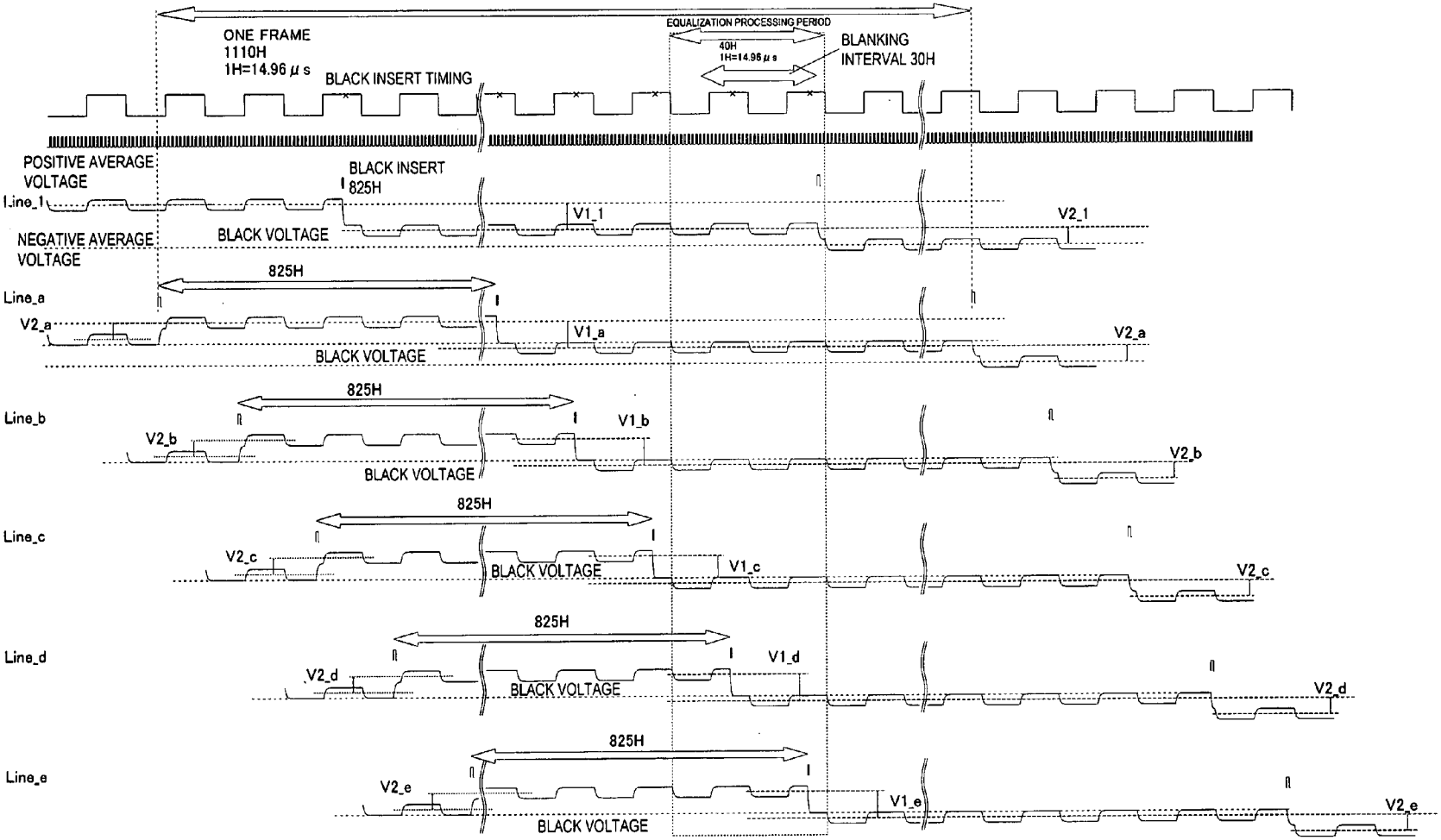
FIG. 2 illustrates a CS voltage waveform, the waveform of a gate clock signal GCK and the waveforms of voltages applied to subpixels on the first, $a^{th}$, $b^{th}$, $c^{th}$, $d^{th}$ and $e^{th}$ rows of pixels (defined for every 20 rows of pixels) in the liquid crystal display device shown in FIG. 1.

Suppose in the Type II liquid crystal display panel with ten types (ten phases) of CS voltages (or CS trunk lines) as disclosed in Patent Document No. 4, the CS voltage oscillates with a period $P_A$ of 20H. In that case, if V-Total is 1,110H, then the V-Total value becomes a half-integral number of times (i.e., 55.5 times) as long as 20H. That is why in a situation where a frame inversion drive, in which the write polarity inverts every frame, is carried out, then the CS voltage will have a continuous rectangular wave with a period of 20H over multiple frames as shown at the top of FIG. 2. Right under the waveform of the CS voltage, shown is the waveform of a gate clock signal GCK, of which the period corresponds with 1H.

The voltage waveforms identified by Line_1, Line_a, Line_b, Line_c, Line_d, and Line_e in FIG. 2 are the waveforms of the voltages applied to the subpixels of the first, $a^{th}$, $b^{th}$, $c^{th}$, $d^{th}$ and $e^{th}$ rows of pixels every $20^{th}$ row of pixels. Also, each small pulse voltage shown over the waveform of the voltage applied to its associated subpixel represents a gate voltage that has been raised to High level. Specifically, the white pulse voltage is a pulse to write image data (which corresponds to Pw to be described later) and the black pulse voltage is a black write gate voltage (which corresponds to Pb to be described later).

Look at the $a^{th}$ row. First, in the frame in which a positive voltage is written, an image data write pulse is applied (i.e., the gate signal is raised to High level), an image data signal is written on the subpixel through a source bus line, and the voltage applied to the subpixel rises. Thereafter, when the CS voltage changes for the first time (i.e., rises in this case) after the image data write pulse has been applied, the voltage applied to subpixel rises and then oscillates synchronously with the CS voltage. This subpixel is a bright subpixel and has an average voltage (i.e., a difference from Vcom) of V1_a in the video write period of 825H. A black write pulse is applied when 825H has passed since the image data write pulse was applied. As a result, a black voltage is written on the subpixel and the voltage applied to the subpixel decreases. In this case, if the subpixel has an ideal chargeability, for example, the voltage applied to the subpixel decreases to a black voltage Vcom. Thereafter, when the CS voltage changes for the first time (i.e., falls in this case) after the black write pulse has been applied, the voltage applied to the subpixel falls and then oscillates synchronously with the CS voltage. In the example illustrated in FIG. 2, the average of the voltage applied to the subpixel during the black write period of 285H is illustrated to be equal to Vcom.

Next, in the frame in which a negative voltage is written, an image data write pulse is applied while the voltage applied to the subpixel has a black voltage level, an image data signal is written on the subpixel through a source bus line, and the voltage applied to the subpixel falls. Thereafter, when the CS voltage changes for the first time (i.e., falls in this case) after the image data write pulse has been applied, the voltage applied to subpixel falls and then oscillates synchronously with the CS voltage. This subpixel has an average voltage (i.e., a difference from Vcom) of V2_a in the video write period of 825H.

Figure 3:
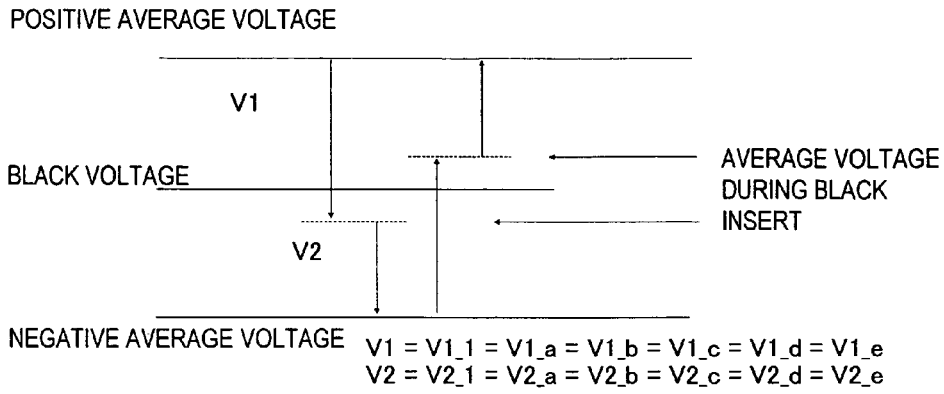
FIG. 3 shows the average of the voltages applied to the subpixels on the first, $a^{th}$, $b^{th}$, $c^{th}$, $d^{th}$ and $e^{th}$ rows during the video write period and that of the voltages applied to those subpixels during the black write period in the liquid crystal display device shown in FIG. 1.

As can be seen from FIG. 3, as for the first, $a^{th}$, $b^{th}$, $c^{th}$, $d^{th}$ and $e^{th}$ rows that are defined every $20^{th}$ row of pixels, the average of the voltages applied to the subpixel during the video write period of a frame in which a positive voltage is applied is equal to V1. On the other hand, the average of the voltages applied to the subpixel during the video write period of a frame in which a negative voltage is applied is equal to V2. That is why looking at two consecutive frames, the subpixels on the first, a th, $b^{th}$, $c^{th}$, $d^{th}$ and $e^{th}$ rows have the same average luminance. Although not described in detail, even during the black write period, the averages of the voltages applied to the respective subpixels on the first, $a^{th}$, $b^{th}$, $c^{th}$, $d^{th}$ and $e^{th}$ rows of pixels are also equal to each other in two consecutive frames.

Figure 4:
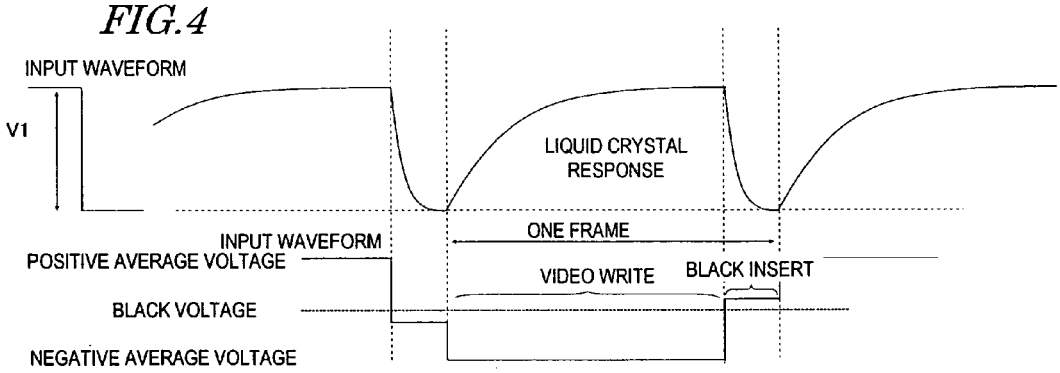
FIG. 4 schematically illustrates the response curve of liquid crystal molecules in the liquid crystal display device shown in FIG. 1.

A waveform representing the response of liquid crystal molecules in each subpixel in such a situation is schematically illustrated in FIG. 4, which shows not only average voltages in the video write and black write periods as input waveforms but also a variation in luminance with time in the respective periods as a liquid crystal response curve. As shown in FIG. 4, in each of the video write and black write periods, the liquid crystal molecules respond so that the luminance substantially reaches a predetermined value. Since the subpixels have the liquid crystal response shown in FIG. 4 in every row of pixels, an image of uniform quality can be presented.

As described above, if one vertical scanning period V-Total has a length of 1,110H and if the CS voltage oscillates with a period $P_A$ of 20H, then it is possible to satisfy the requirement that V-Total be a half-integral number of times as long as one period $P_A$ of oscillation of the CS voltage. That is why no matter whether data should be written in the effective display period or in the vertical blanking interval (i.e., in the video write period or in the black write period in this case), every pixel has the same phase relation between the timing to write the data and the waveform of its associated CS voltage. As a result, a display operation can be performed with a uniform luminance over the entire screen.

Next, a situation where one vertical scanning period V-Total has a length of 1,116H, one effective display period V-Disp has a length of 1,080H and one vertical blanking interval V-Blank has a length of 36H will be described with reference to FIGS. 5 through 8. In the following example, 1H is supposed to be 14.88 μs.

Figure 5:
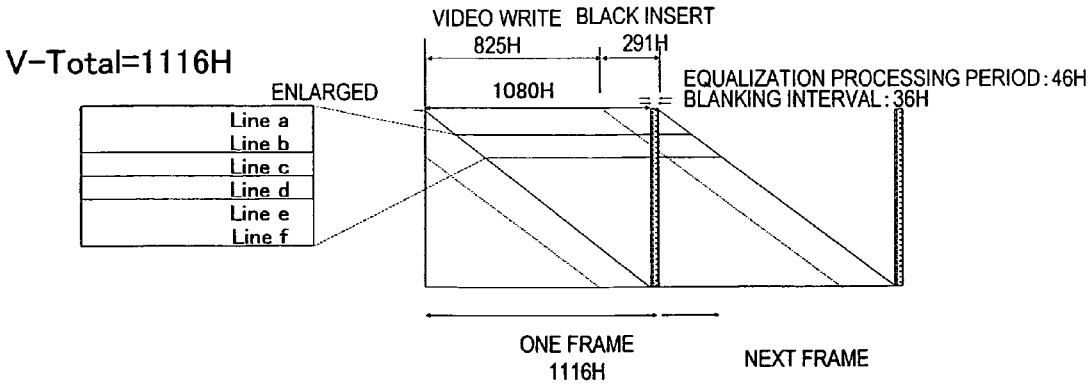
FIG. 5 illustrates why the luminance varies if the liquid crystal display device disclosed in Patent Document No. 4 performs a black insert drive operation in a situation where one vertical scanning period V-Total has a length of 1,116H, the effective display period V-Disp thereof has a length of 1,080H, the vertical blanking interval V-Blank thereof has a length of 36H and the equalization processing period thereof has a length of 46H.

As shown in FIG. 5, V-Total is supposed to consist of a video write period of 825H and a black insert (or black display) period of 291H. The equalization processing period of 46H shown in FIG. 5 corresponds to a period with the second type of waveform in the CS voltage waveform controlling method disclosed in Patent Document No. 4 (i.e., the second period in Patent Document No. 4). In the remaining period other than the equalization processing period (i.e., in the first period in Patent Document No. 4), the CS voltage has a first type of waveform that oscillates with a period $P_A$ of 20H, while the second type of waveform is a waveform that switches from High level into Low level, or vice versa, every 23H. The High and Low levels of the second type of waveform are the same as those of the first type of waveform. That is why the first and second types of waveforms have the same average, too.

By performing the equalization processing with the second type of waveform provided in this manner, if only the video write operation needs to be performed during each vertical scanning period, the write operation can get done on every pixel within the effective display period and the continuity of the CS voltage waveform can be maintained over two consecutive frames as can be seen from FIG. 5.

On the other hand, if the video write operation and the black write operation need to be both performed during each vertical scanning period, part of the black write operation cannot be finished within the effective display period but should be carried out during the vertical blanking interval as can be seen from FIG. 5. In that case, the image may have a noticeable luminance difference between the bright and dark portions thereof in some cases. Hereinafter, it will be described with reference to FIGS. 6 through 8 why such a luminance difference is produced.

Figure 6:
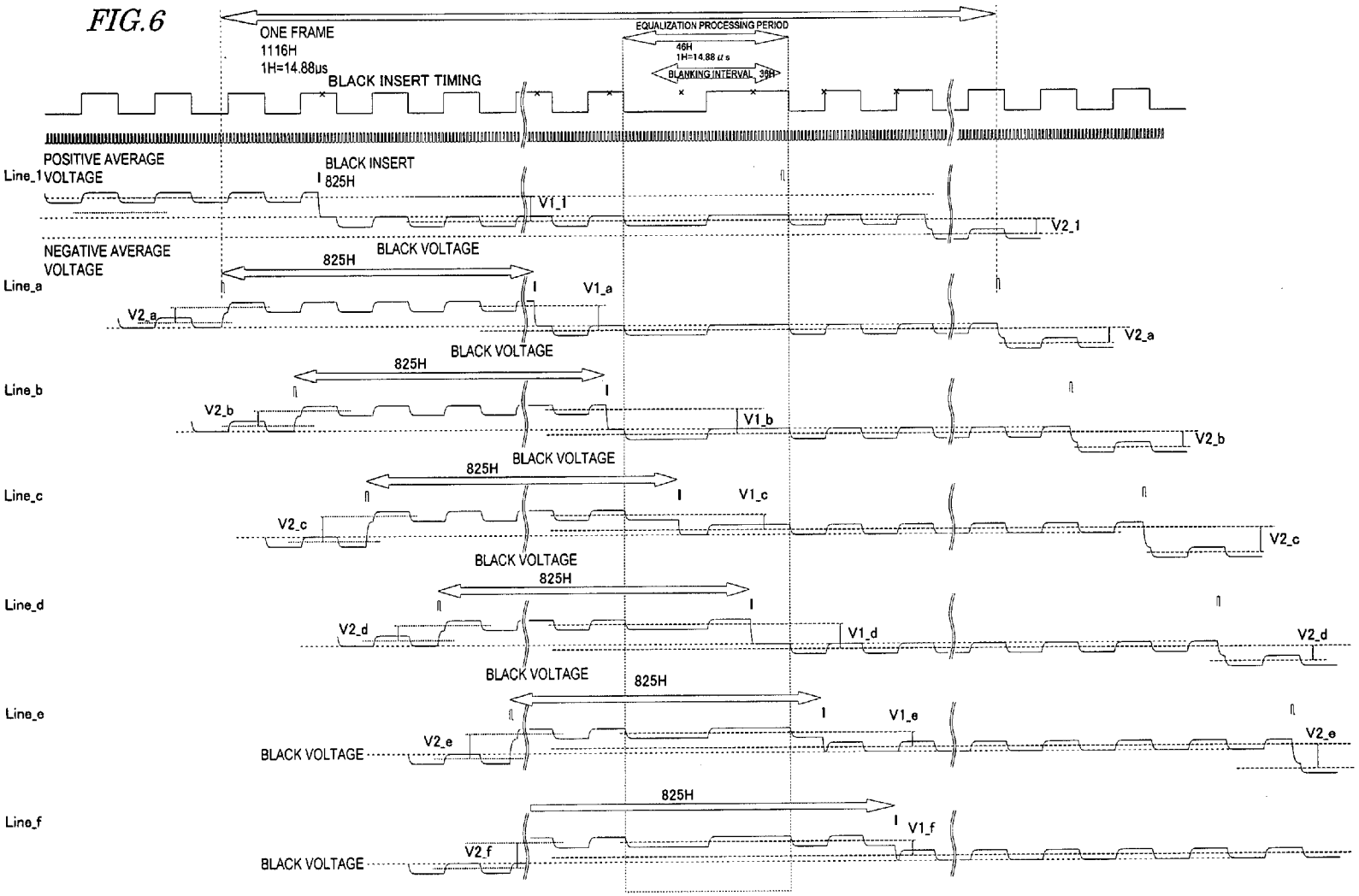
FIG. 6 illustrates a CS voltage waveform, the waveform of a gate clock signal GCK and the waveforms of voltages applied to subpixels on the first, $a^{th}$, $b^{th}$, $c^{th}$, $d^{th}$, $e^{th}$ and $f^{th}$ rows of pixels (defined for every 20 rows of pixels) in the liquid crystal display device shown in FIG. 5.

Just like FIG. 2, the waveform of the CS voltage, the waveform of the gate clock signal GCK, and the waveforms of the voltages applied to subpixels on the first, $a^{th}$, $b^{th}$, $c^{th}$, $d^{th}$, $e^{th}$, and $f^{th}$ rows of pixels (every $20^{th}$ row of pixels) are shown in this order (top to bottom) in FIG. 6.

Although it will not be described in detail, if the video write period has a length of 825H and the black insert period has a length of 291H, then the black voltage is also written even during the equalization processing periods (including vertical blanking intervals) as indicated by the crosses × on the uppermost CS voltage waveform shown in FIG. 6. That is why not every row of pixels has the same phase relation between the timing to write the black voltage and the oscillation waveform of the CS voltage.

Figure 7:
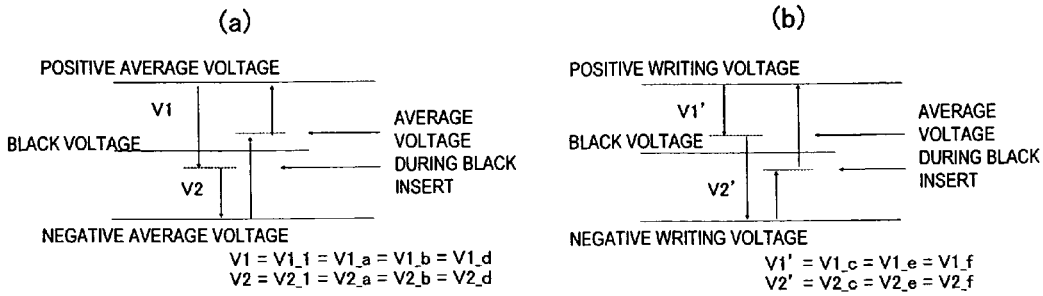
FIGS. 7(*a*) and 7(*b*) show the averages of the voltages applied to respective subpixels during the video write period and the black write period in the liquid crystal display device shown in FIG. 5, wherein FIG. 7(*a*) shows the averages of the voltages applied to the subpixels on the first, $a^{th}$, $b^{th}$ and $d^{th}$ rows, while FIG. 7(*b*) shows the averages of the voltages applied to the subpixels on the $c^{th}$, $e^{th}$ and $f^{th}$ rows.

That is why as can be seen from FIGS. 7(*a*) and 7(*b*) showing the voltages applied to the subpixels on the respective rows of pixels, the voltages applied to the subpixels on the first, a th, $b^{th}$, and $d^{th}$ rows become either V1 (for a frame in which a positive voltage is applied) or V2 (for a frame in which a negative voltage is applied) as shown in FIG. 7(*a*). On the other hand, the voltages applied to the subpixels on the $c^{th}$, $e^{th}$, and $f^{th}$ rows become either V1' (for a frame in which a positive voltage is applied) or V2' (for a frame in which a negative voltage is applied) as shown in FIG. 7(*b*).

Figure 8:
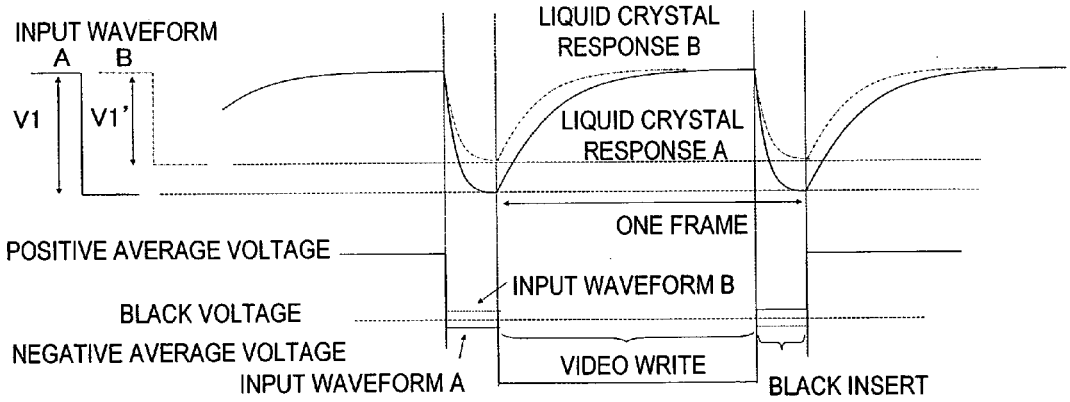
FIG. 8 schematically illustrates the liquid crystal response curves of the liquid crystal display device shown in FIG. 7, where the input waveforms A and B represent the situations shown in FIGS. 7(*a*) and 7(*b*), respectively.
Figure 9:
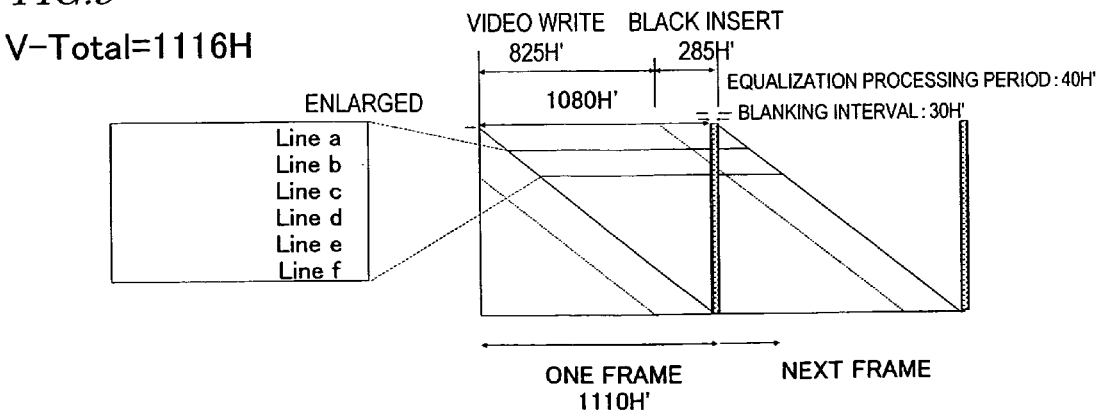
FIG. 9 illustrates how the variation in luminance can be eliminated if a liquid crystal display device as a preferred embodiment of the present invention performs a black insert drive operation in a situation where the input video signal has one vertical scanning period V-Total of 1,116H, while the display panel has one effective display period V-Disp of 1,080H', one vertical blanking interval V-Blank of 30' H and one vertical scanning period (one frame) of 1,110H.

FIG. 8 schematically shows the liquid crystal response curves of the respective subpixels in such a situation. FIG. 8 shows not only average voltages in the video write and black write periods as input waveforms but also variations in luminance with time in the respective periods as liquid crystal response curves. In FIG. 8, the input waveform A represents the situation shown in FIG. 7(*a*), while the input waveform B represents the situation shown in FIG. 7(*b*). As can be seen from FIG. 8, the liquid crystal response curve A associated with the input waveform A is different from the liquid crystal response curve B associated with the input waveform B. Among other things, since there is a lag between the timings to write the black voltage, the luminance levels to be reached during the black write period are different from each other. That is why the average of the liquid crystal response curve A with time does not agree with that of the liquid crystal response curve B. As a result, unevenness in luminance (i.e., a noticeable difference between the bright and dark portions) is sometimes seen on the screen.

Next, a liquid crystal display device and its driving method according to this preferred embodiment will be described with reference to FIGS. 9 through 14.

As already described with reference to FIGS. 1 through 4, as long as one vertical scanning period V-Total of the input video signal has an ideal length (that should be a multiple of one horizontal scanning period), even if data is written during a vertical blanking interval, no problems will arise. However, as described with reference to FIGS. 5 through 8, once one vertical scanning period V-Total of the input video signal no longer has an ideal length, some problems shall arise. The ideal length of one vertical scanning period V-Total of the input video signal should be a half-integral number of times as long as one period $P_A$ of oscillation of the CS voltage in cases of the frame inversion drive as described above. However, the ideal length of one vertical scanning period V-Total of the input video signal does not have to be such a value but may also be either an integral number of times, or a half-integral number of times, as long as one period $P_A$ of oscillation of the CS voltage, which depends on the connection pattern of the CS bus line such as the sequence (++−−) of the drive polarity.

If one horizontal scanning period and one vertical scanning period of the input video signal are represented by 1H and V-Total, respectively, one vertical scanning period V-Total may consist of a first period in which one horizontal scanning period of the liquid crystal display panel is 1Ho, which is as long as 1H, and a second period (adjustment period) in which one horizontal scanning period of the liquid crystal display panel is 1Hn, which is not as long as 1H, in the liquid crystal display device of this preferred embodiment of the present invention. That is to say, by partially using 1Hn, which is not as long as one horizontal scanning period (1H) of the input video signal, as one horizontal scanning period of the display panel, the number of horizontal scanning periods included in one vertical scanning period can be adjusted. That is why even if V-Total of the input video signal has deviated from its ideal length, the number of horizontal scanning periods included in one vertical scanning period of the display panel can still be the ideal value by determining Hn appropriately. It should be noted that one vertical scanning period of the display panel is as long as one vertical scanning period of the input video signal.

The liquid crystal display device of this preferred embodiment includes a display panel with multiple pixels and a display controller that receives an input video signal and a sync signal and gets an image presented on the display panel. The input video signal and the sync signal may be supplied as a composite video signal.

The display controller controls the length of one horizontal scanning period by the number of gate clock pulses GCK applied to the display panel. That is why a control operation needs to be carried out such that the number of gate clock pulses GCK per frame becomes equal to an ideal value such as 1,110. According to this method, V-Total can always have an ideal length without depending on V-Total of the input video signal.

However, there is no need to change the lengths of one horizontal scanning period over the entire V-Total period. But only in a fraction (i.e., the second period) of V-Total, one horizontal scanning period preferably has a length of 1Hn that is not as long as 1H. In that case, the CS voltage will have a waveform that oscillates with two different periods that are an integral number of times as long as Ho and Hn in the first and second periods, respectively.

Also, the second period is preferably a single continuous period. In other words, the second period preferably consists of a number of consecutive horizontal scanning periods. Furthermore, the second period is preferably an integral number of times as long as 1Hn. By adjusting the length of one horizontal scanning period in this manner, one period of oscillation of the CS voltage in the second period can also be an integral number of times as long as 1Hn.

In cases of the frame inversion drive, one period of oscillation of the CS voltage in the second period is preferably an integral number of times as long as one horizontal scanning period. For instance, as will be described in the following example, each of CS voltages with ten phases oscillates with a period of 20 horizontal scanning periods and those CS voltages have ten different waveforms, which shift from each other by one-tenth of one oscillation period (i.e., by two horizontal scanning periods). Thus, if the second period consists of 20 consecutive horizontal scanning periods (which is as long as one period of oscillation of the CS voltage), then the CS voltage can have the same average in the first and second periods.

Furthermore, the second period is preferably provided within the vertical blanking interval V-Blank in order to avoid making a read error of the display data. A normal liquid crystal display device receives data corresponding to one row of pixels every 1H and writes data corresponding to one row of pixels every 1H, too. That is why if the rate of the input signal were different from the rate of the write signal, then the relation described above could not be satisfied anymore. And to avoid such an error, a memory that can store data for one frame would be needed, thus increasing the cost significantly. Meanwhile, the vertical blanking interval V-Blank is an interval in which no effective input signals are received. For that reason, even if the (real time) length of one horizontal scanning period changed in that period, the relation described above should not be affected.

A liquid crystal display device to be described as a preferred embodiment of the present invention with reference to FIGS. 9 through 14 can overcome the problems with the conventional liquid crystal display device (see Patent Document No. 4) that has already been described with reference to FIGS. 5 through 8. In the following example, one vertical scanning period V-Total has a length of 1,116H, which consists of an effective display period V-Disp of 1,080H and a vertical blanking interval V-Blank of 36H. 1H also has a length of 14.88 μs.

In this preferred embodiment of the present invention, the length of one horizontal scanning period is adjusted, and therefore, there are multiple horizontal scanning periods with mutually different real time lengths. Thus, those horizontal scanning periods will be distinguished in the following manner.

First of all, H will also represent one horizontal scanning period of the input video signal as in the foregoing description. That is why as for the input video signal, V-Total=m×H, V-Disp=$m_0$×H, and V-Blank=(m−$m_0$)×H (where m and $m_0$ are positive integers) need to be satisfied. In this example, m=1,116, $m_0$=1,080 and (m−$m_0$)=36.

Meanwhile, as for the liquid crystal display panel, $m_1$, $m_2$ and Hn should be determined such that V-Disp=$m_0$×Ho, V-Blank=$m_1$×Ho+$m_2$×Hn and the ideal value is $m_0$+$m_1$+$m_2$. In this example, the ideal value is 1,110. Ho and H actually have the same real time length but are both used here in order to represent one horizontal scanning period of the liquid crystal display panel definitely.

Figure 10:
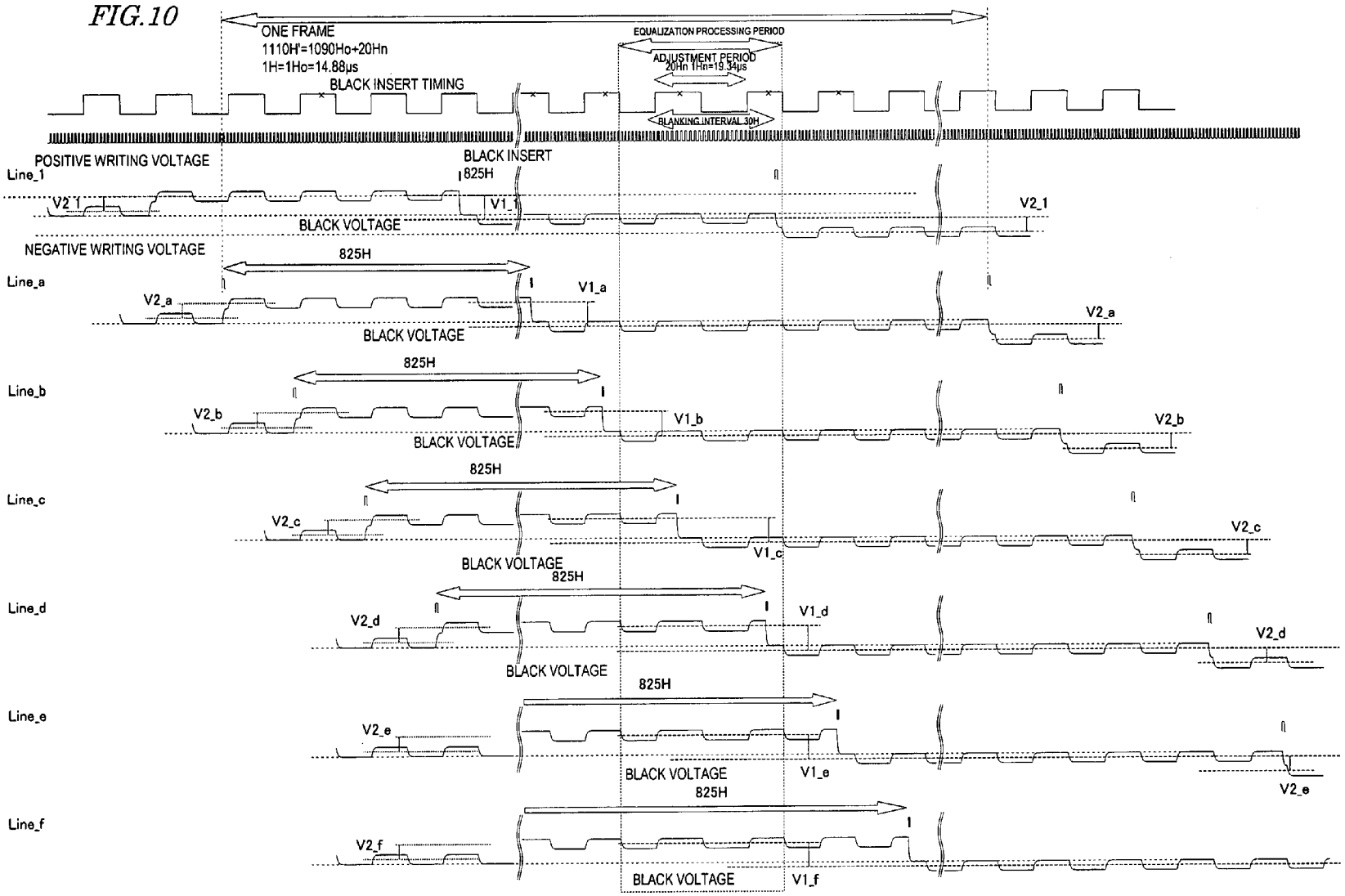
FIG. 10 illustrates a CS voltage waveform, the waveform of a gate clock signal GCK and the waveforms of voltages applied to subpixels on the first, $a^{th}$, $b^{th}$, $c^{th}$, $d^{th}$, $e^{th}$ and $f^{th}$ rows of pixels (defined for every 20 rows of pixels) in the liquid crystal display device shown in FIG. 9.

Just like FIG. 6, the waveform of the CS voltage, the waveform of the gate clock signal GCK, and the waveforms of the voltages applied to subpixels on the first, $a^{th}$, $b^{th}$, $c^{th}$, $d^{th}$, $e^{th}$, and $f^{th}$ rows of pixels (every $20^{th}$ row of pixels) are shown in this order (top to bottom) in FIG. 10.

As indicated by 1110H' in FIG. 10, the number of horizontal scanning periods included in one frame of the liquid crystal display panel is supposed to be 1,110. H' represents just conceptually horizontal scanning periods to achieve the ideal value and is not a period with a particular real time length.

In the example illustrated in FIG. 10, by setting 1H=1Ho=14.88 μs, $m_0$=1,080, $m_1$=10, $m_2$=20 and Hn=19.34 μs, $m_0$+$m_1$+$m_2$=1,110 is satisfied. Naturally, V-Total remains the same and 1,116H=1,090Ho+20Hn is satisfied.

As described above, by providing the second period, of which one horizontal scanning period Hn is different from H of the input video signal, as an adjustment period, every row of pixels can have the same phase relation between the timing to write the black voltage and the oscillation waveform of the CS voltage, although the black voltage is written during the vertical blanking interval as indicated by the crosses × on the CS voltage waveform at the top of FIG. 10.

Figure 11:
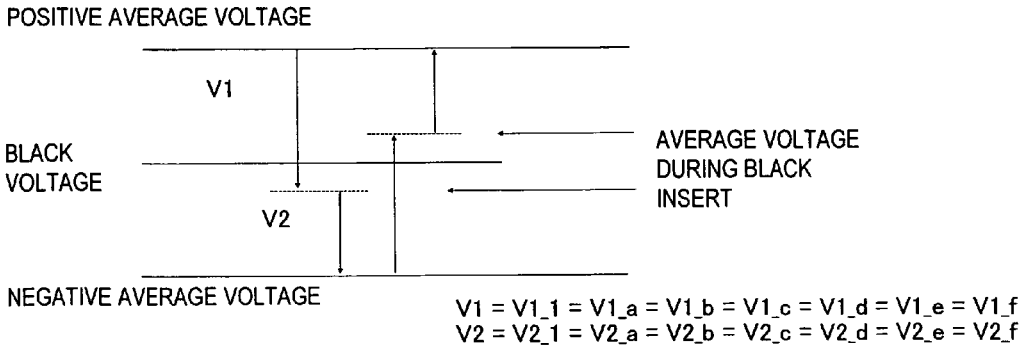
FIG. 11 shows the average of the voltages applied to the subpixels on the first, $a^{th}$, $b^{th}$, $c^{th}$, $d^{th}$, $e^{th}$ and $f^{th}$ rows during the video write period and that of the voltages applied to those subpixels during the black write period in the liquid crystal display device shown in FIG. 9.

As a result, as can be seen from FIG. 11, as for the first, $a^{th}$, $b^{th}$, $c^{th}$, $d^{th}$, $e^{th}$ and $f^{th}$ rows that are defined every $20^{th}$ row of pixels, the average of the voltages applied to the subpixel during the video write period of a frame in which a positive voltage is applied is equal to V1. On the other hand, the average of the voltages applied to the subpixel during the video write period of a frame in which a negative voltage is applied is equal to V2. That is why looking at two consecutive frames, the subpixels on the first, $a^{th}$, $b^{th}$, $c^{th}$, $d^{th}$, $e^{th}$ and $f^{th}$ rows have the same average luminance. Although not described in detail, even during the black write period, the averages of the voltages applied to the respective subpixels on the first, $a^{th}$, $b^{th}$, $c^{th}$, $d^{th}$, $e^{th}$ and $f^{th}$ rows of pixels are also equal to each other in two consecutive frames.

Figure 12:
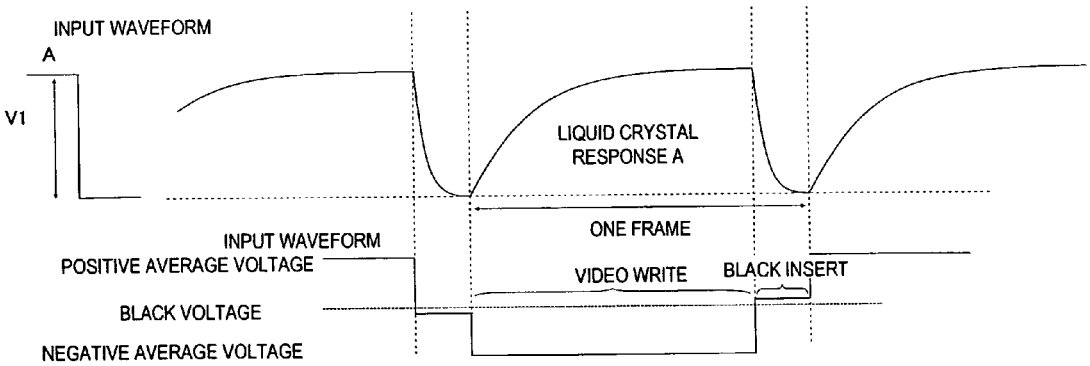
FIG. 12 schematically illustrates the response curve of liquid crystal molecules in the liquid crystal display device shown in FIG. 11.

A waveform representing the response of liquid crystal molecules in each subpixel in such a situation is schematically illustrated in FIG. 12, which shows not only average voltages in the video write and black write periods as input waveforms but also a variation in luminance with time in the respective periods as a liquid crystal response curve. As shown in FIG. 12, in each of the video write and black write periods, the liquid crystal molecules respond so that the luminance substantially reaches a predetermined value. Since the subpixels have the liquid crystal response shown in FIG. 12 in every row of pixels, an image of uniform quality can be presented.

Hereinafter, it will be described how to determine $m_1$, $m_2$ and Hn. Suppose the CS voltage has one period of oscillation of $P_A$ and the number of horizontal scanning periods included in $P_A$ is Tsc during the first period.

First, $m_1$ is calculated by the following equation:

$$m_1=Tcs\times(n_1+1/2)-m_0$$

where $0\le m_1\le m_0$ and $n_1$ is a positive integer. But the best $m_1$ value satisfies $0\le m_1\le$Tcs.

Next, $m_2$ is calculated by the following equation:

$$m_2=Tcs\times n_2$$

where $n_2$ is a positive integer. But the best $m_2$ value satisfies:

$$(Tcs/2)\times n_2+(Tcs/2)\times(n_2-1)\le(m-m_0)-m_1\le(Tcs/2)\times n_2+(Tcs/2)\times(n_2+1)$$

And then $m_0$+$m_1$+$m_2$ is calculated.

Hn is calculated by the following equation:

$$[m\times Ho-(m_0+m_1)\times Ho]\div m_2$$

Hereinafter, the foregoing example will be described with specific figures. First of all, m=1,116, $m_0$=1,080 and Tsc=20 are determined by the input signal.

Next, $m_1$ is calculated by the following equation:

$$m_1=20\times(n_1+1/2)-1080$$

As $0\le m_1$, $54\le n_1$ needs to be satisfied. And

If $n_1$=54, then 20×54.5−1080=10, but if $n_1$=55, then 20×55.5−1080=30.

Since the best m value satisfies $0\le m<20$, $m_1$=10 (if $n_1$=54).

Subsequently, $m_2$ is calculated by the following equation:

$$m_2=20\times n_2$$

As the best $n_2$ value needs to satisfy $$(20/2)\times n_2+(20/2)\times(n_2-1)\leq 36-10\leq(20/2)\times n_2+(20/2)\times(n_2+1)$$

If $n_2=0$, then $-10\leq 26\leq 10$, which is NG,

If $n_2=1$, then $10\leq 26\leq 30$, which is OK, and

If $n_2=2$, then $30\leq 26\leq 50$, which is NG,

Therefore, the best $n_2$ value becomes 1 and $m_2=20$.

Consequently, $m_0+m_1+m_2=1080+10+20=1110$.

And Hn is calculated by $$(1116\times Ho-(1080+10)\times Ho)\div 20=1.3Ho$$

Figure 13:
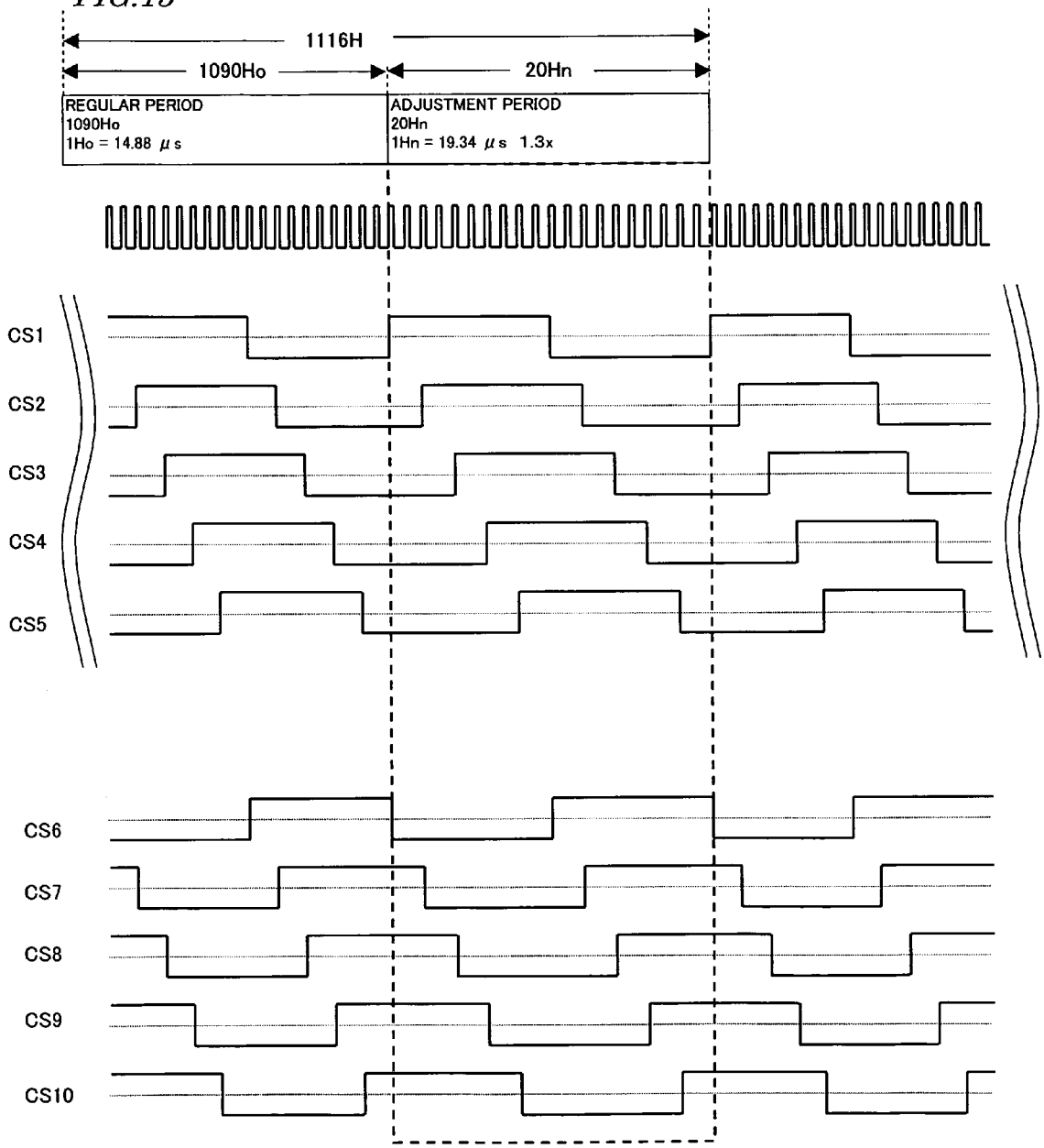
FIG. 13 illustrates CS voltage waveforms for around an adjustment period (i.e., the second period) in a liquid crystal display device according to a preferred embodiment of the present invention in a preferable situation where the adjustment period (the second period) is as long as one period of the CS voltage.

FIG. 13 illustrates the CS voltage waveform thus determined for around the adjustment period (i.e., the second period) in the liquid crystal display device of this preferred embodiment. As shown in FIG. 13, the adjustment period (i.e., the second period) is preferably as long as one period of the CS voltage. This is because in that case, the average voltage in the adjustment period will agree with the one in the other period in each of the CS voltages CS1 through CS10 with ten phases.

Figure 14:
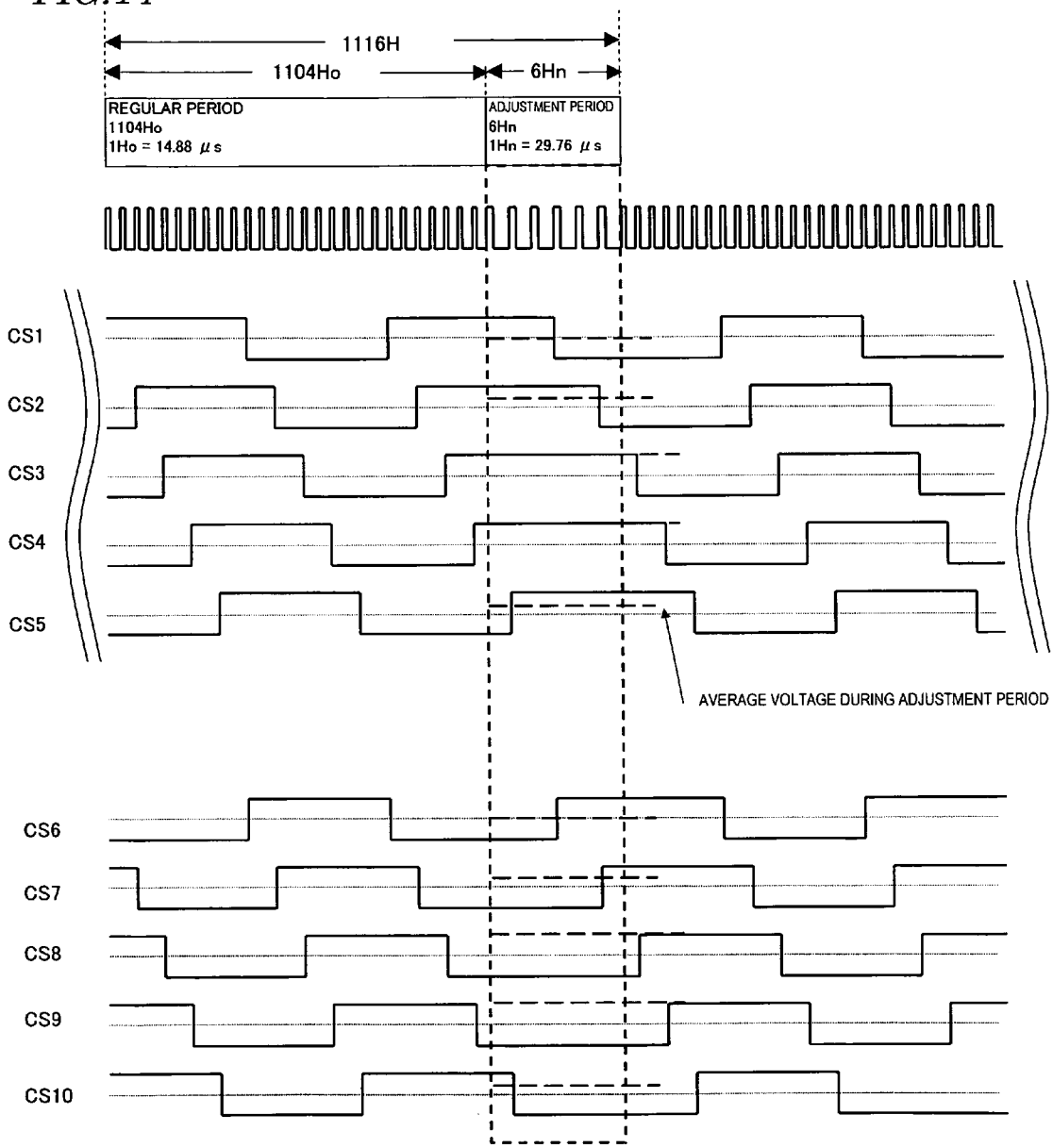
FIG. 14 illustrates CS voltage waveforms for around the adjustment period (the second period) in a liquid crystal display device according to a preferred embodiment of the present invention in a non-preferred situation where the adjustment period (the second period) is shorter than one period of the CS voltage.

As shown in FIG. 14, if the adjustment period were shorter than one period of the CS voltage, then the average CS voltages in the adjustment periods would not agree with each other, which is a problem.

In the preferred embodiments described above, the number of electrically independent storage capacitor trunks is supposed to be smaller than that of storage capacitor lines (i.e., CS bus lines), which corresponds to Type I or Type II arrangement disclosed in Patent Document No. 4. Naturally, however, an arrangement in which CS voltages are supplied to the respective storage capacitor lines independent of each other may also be adopted. In that case, a CS voltage should change its levels at least once after the gate voltage has gone low during one vertical scanning period. Also, in a liquid crystal display device that includes storage capacitor lines that are twice as many as the gate bus lines and has an arrangement for supplying CS voltages to those storage capacitor lines independent of each other, if the CS voltage should change its levels only once after the gate voltage has gone low, then either the interval between the fall of the gate voltage to low level and the first change of the CS voltage levels or the interval between the change of the CS voltage levels and the rise of the gate voltage to high level next time during one vertical scanning period is preferably defined to be the same on every display line.

Conversely, if an arrangement in which a single storage capacitor. trunk is provided for multiple storage capacitor lines is adopted, then the CS voltages on those storage capacitor lines that are all connected to a single storage capacitor trunk can have exactly the same amplitude of oscillation. Naturally, the circuit configuration can be simplified compared to a situation where a lot of voltages are provided independent of each other.

Hereinafter, a black insert driving method, to which a liquid crystal display device as a preferred embodiment of the present invention is applicable effectively, will be described.

Figure 15:
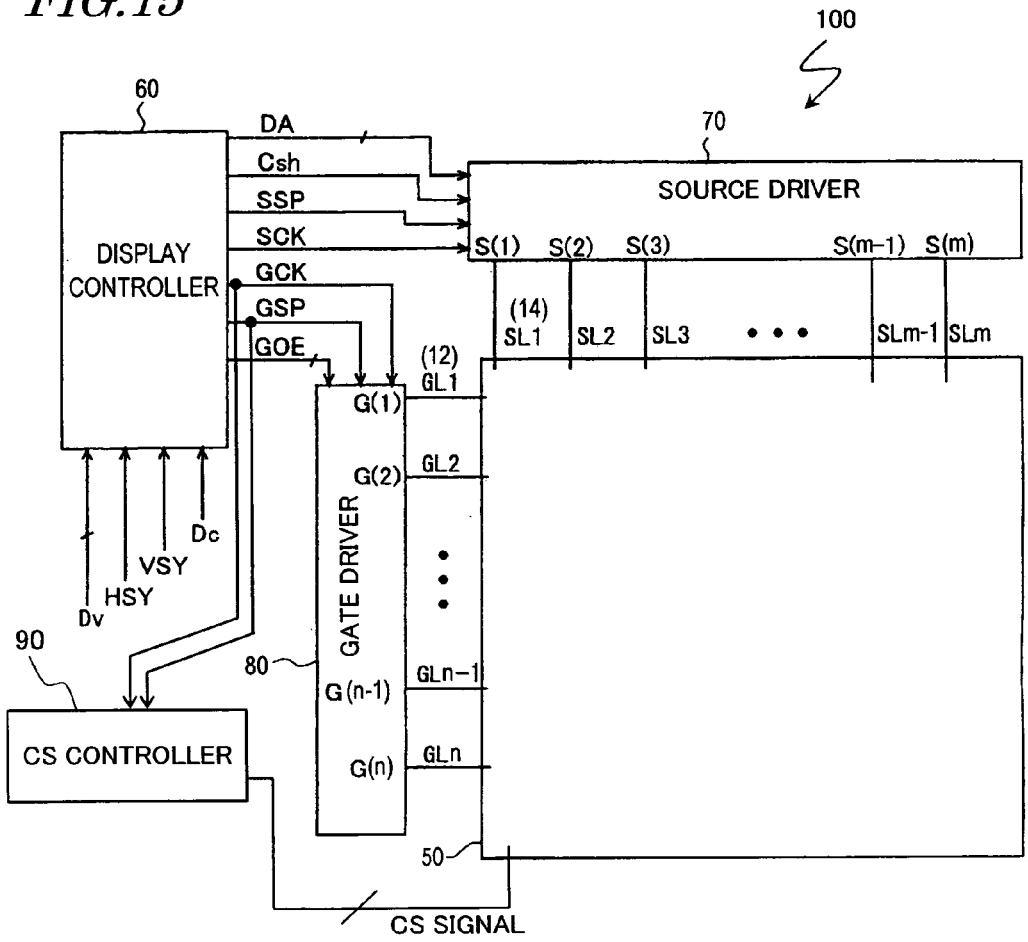
FIG. 15 schematically illustrates a configuration for a liquid crystal display device 100 as a preferred embodiment of the present invention.

FIG. 15 schematically illustrates a configuration for a liquid crystal display device as a preferred embodiment of the present invention. The liquid crystal display device 100 includes a display section 50, a display controller 60, a source driver 70, a gate driver 80, and a CS voltage controller (or CS controller) 90. Typically, the source driver 70, the gate driver 80 and the CS voltage controller 90 are either integrated together with a liquid crystal cell with the display section 50 (e.g., a TFT substrate among other things) or implemented as an IC. The liquid crystal cell including the TFT substrate and a color filter substrate, and the source driver 70, the gate driver 80 and the CS voltage controller 90 will be collectively referred to herein as a "liquid crystal display panel".

The display section 50 has any of the multi-pixel structures of the liquid crystal display devices disclosed in Patent Documents Nos. 3 and 4. To achieve a high pixel aperture ratio, among other things, the Type II arrangement disclosed in Patent Document No. 4 is preferably adopted (see FIG. 15(*b*) of Patent Document No. 4). If the Type II arrangement is adopted, two adjacent subpixels of two different pixels that are adjacent to each other in the column direction have their associated storage capacitor counter electrodes connected to a common CS bus line, which is arranged between those two pixels that are adjacent to each other in the column direction, thereby making the CS bus line function as an opaque layer, too. As a result, not just can the number of CS bus lines be reduced but also can the pixel aperture ratio be increased by removing the opaque layer that should otherwise be provided separately. Also, supposing the number of electrically independent CS trunks is an even number L, one period of oscillation of an oscillating voltage can be 2×K×L times (where K is a positive integer) as long as one horizontal scanning period.

The display controller 60 receives a digital video signal Dv representing an image to present, a horizontal sync signal HSY and a vertical sync signal VSY associated with the digital video signal Dv, and a control signal Dc to control the display operation from external signal sources. Then, based on these signals Dv, HSY, VSY and Dc, the display controller 60 outputs a data start pulse signal SSP, a data clock signal SCK, a short-circuit control signal Csh, and a digital image signal DA representing the image to present (corresponding to the digital video signal Dv) to the source driver 70 as signals for getting the image represented by the digital video signal Dv presented on the display section 50. In this case, the short-circuit control signal Csh is a signal unique to the black insert drive done by the liquid crystal display device of this preferred embodiment as will be described later, and is a signal for controlling the timing to short-circuit two adjacent source bus lines (e.g., source bus lines SL1 and SL2 or SL2 and SL3), to which signal voltages with mutually different polarities are supplied in the one dot inversion drive.

The display controller 60 also outputs the gate start pulse signal GSP, the gate clock signal GCK and the gate driver output control signal GOE to the gate driver 80 and further outputs the gate start pulse signal GSP and the gate clock signal GCK to the CS controller 90. In this case, the display controller 60 in the liquid crystal display device 100 of this preferred embodiment determines the length of one horizontal scanning period Hn for adjustment based on V-Total (corresponding to one period of VSY) and one horizontal scanning period H (corresponding to one period of HSY) of the digital video signal Dv that has been input to the display controller 60, generates a GCK signal to control the duration and timing of Ho and Hn, and then outputs it to the gate driver 80 and the CS voltage controller 90. As a result of this operation, the device is controlled such that the oscillation waveforms of the CS voltage are changed every predetermined count of GCK irrespective of V-Total of the digital video signal as an input video signal, thus realizing a high display quality with no brightness unevenness just as already described. Optionally, if the adjustment period to change the lengths of one period of GCK is defined within the vertical blanking interval, then SSP and SCK for controlling the input and output of data to/from the source driver do not have to be changed but values defined by the input signal could be used. This is because the vertical blanking interval includes no effective display data.

Based on a digital image signal DA and the start pulse signal SSP and clock signal SCK for the source driver, the source driver 70 sequentially generates data signal voltages S(1), S(2), . . . and S(m) every horizontal scanning period as analog voltages representing pixel values on respective horizontal scan lines of the image represented by the digital image signal DA, and then supplies those data signal voltages S(1), S(2), . . . and S(m) onto the respective source bus lines SL1, SL2, . . . and SLm. The liquid crystal display device 100 of this preferred embodiment performs a drive operation so as to invert the polarity of the voltage applied to the liquid crystal layer (with respect to the counter voltage) not only every vertical scanning period (which corresponds with one frame in this case) but also every gate bus line and every source bus line. That is to say, the liquid crystal display device performs a so-called "one dot inversion drive".

The source driver 70 performs the black insert drive operation by providing a period in which a source bus line is electrically short-circuited with one of its adjacent source bus lines with the opposite polarity (i.e., those two source bus lines are made to share the same charge) when the polarity of a data signal voltage is inverted. Such a black insert driving method will be referred to herein as a "charge sharing impulse (CSI) driving" method. It should be noted, however, that during this charge sharing period, pixels do not have to have a perfectly black display state (i.e., at the $0^{th}$ grayscale) but could have a luminance (or grayscale) that is about 40% as high as in the white display state (e.g., at the $255^{th}$ grayscale if the display operation is performed in 256 grayscales). Furthermore, during one vertical scanning period, the number of times the charge sharing period is provided for each pixel does not have to be only once but may also be twice or more. In general, a data signal voltage is written (which is also called "video writing") once a vertical scanning period. For that reason, to leave time for writing the data signal voltage sufficiently (i.e., to charge the pixel capacitor fully), the charge sharing period is preferably defined to be shorter than the data signal voltage write period. Furthermore, to achieve the effect of the pseudo-impulse drive, the black display period preferably accounts for 20% to 50% of one vertical scanning period.

According to the CSI driving method, not just can the power dissipation be cut down but also can the load on the source driver 70 be lightened compared to a driving method in which the black voltage, as well as the data signal voltage, should be supplied from the source driver 70.

Hereinafter, a configuration for the output section that is included in the source driver 70 to perform the CSI drive operation will be described with reference to FIG. 16.

Figure 16:
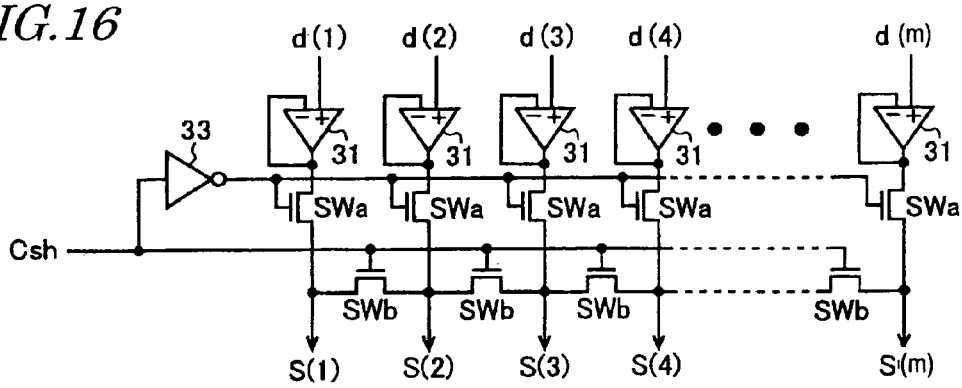
FIG. 16 schematically illustrates a circuit configuration for the output section of the source driver 70 in the liquid crystal display device 100 shown in FIG. 15.

As shown in FIG. 16, the output section of the source driver 70 receives analog signal voltages d(1), d(2), . . . and d(m) that have been generated based on the digital image signal DA, performs an impedance transformation on those analog signal voltages d(1), d(2), . . . and d(m) to generate data signal voltages S(1), S(2), . . . and S(m), and supply them to source bus lines SL1, SL2, . . . and SLm. The impedance transformation is carried out using a number m of buffers 31 functioning as voltage followers. A first type of MOS transistor SWa is connected as a switching element to the output terminal of each of those buffers 31. The data signal voltage S(i) (where i is an integer of one through m) of each buffer 31 is output from its associated output terminal of the source driver 70 by way of its associated MOS transistor Swa of the first type. Also, each pair of adjacent output terminals of the source driver 70 is connected together with a second type of MOS transistor SWb also functioning as a switching element. A short-circuit control signal Csh is applied to the gate terminal of each MOS transistor SWb of the second type. On the other hand, a signal, generated by having the logical level of the short-circuit control signal Csh inverted by an inverter 33, is applied to the gate terminal of each MOS transistor SWa of the first type. That is why if the short-circuit control signal Csh is not activated (at Low level), the first type of MOS transistors SWa are turned ON but the second type of MOS transistors SWb are turned OFF. As a result, the data signal voltage S(i) of each buffer 31 is output from the source driver 70 by way of its associated MOS transistor SWa of the first type. On the other hand, if the short-circuit control signal Csh is activated (at High level), the first type of MOS transistors SWa are turned OFF but the second type of MOS transistors SWb are turned ON. As a result, the data signal voltage S(i) of each buffer 31 is not supplied to the source bus lines SL1, SL2, . . . and SLm but each adjacent pair of the source bus lines SL1, SL2, . . . and SLm is short-circuited together with its associated MOS transistor SWb of the second type.

Figure 17:
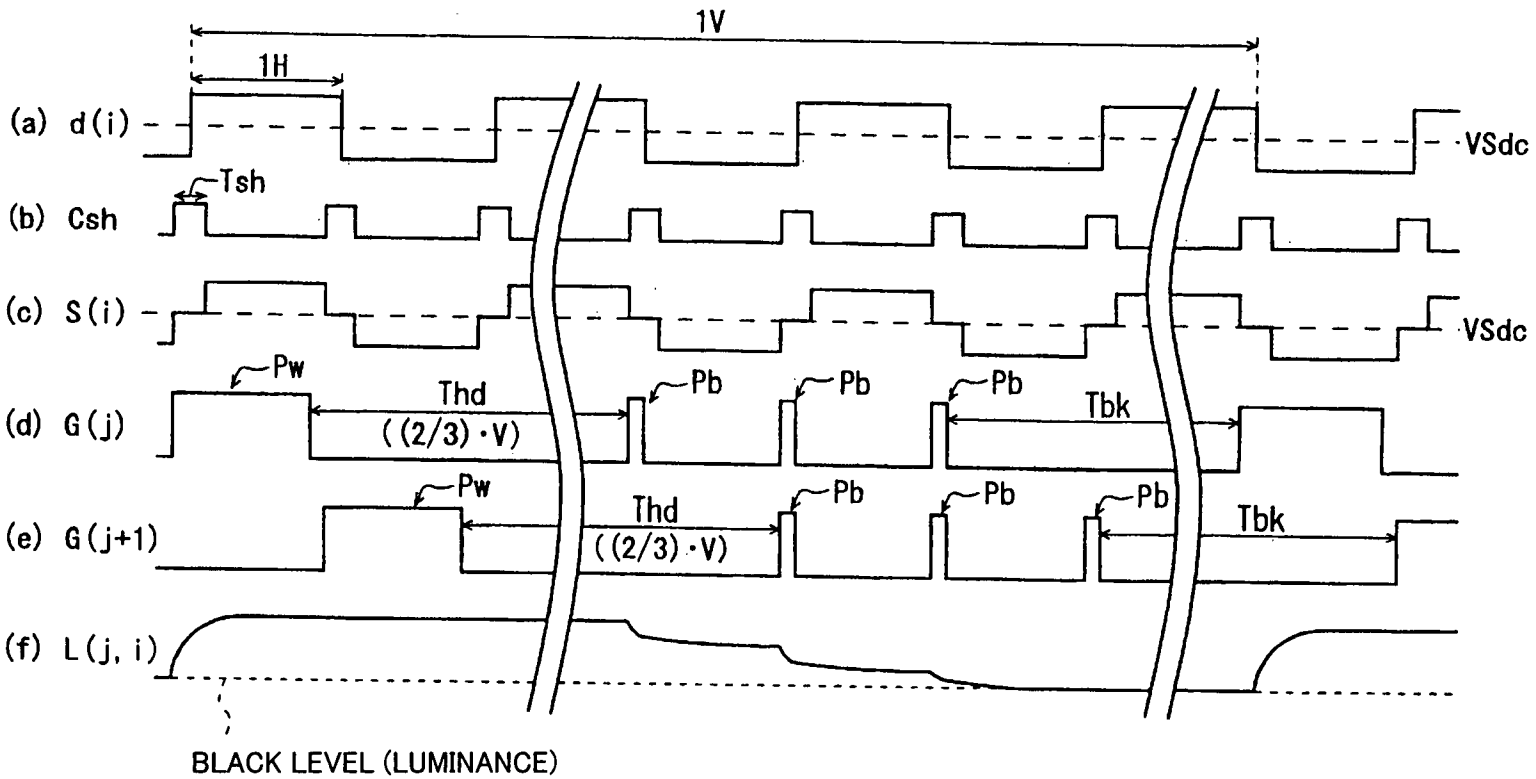
FIG. 17 illustrates how the liquid crystal display device 100 performs a CSI drive operation, wherein portions (a), (b), (c), (d), (e) and (f) illustrate the respective waveforms of an analog signal voltage d(i), a short-circuit control signal Csh, a source bus line potential S(i), scan signal voltages G(j) and G(j+1) including image data write pulse Pw and black voltage application pulse Pb, and a voltage applied to the pixel (subpixels), respectively.
Figure 18:
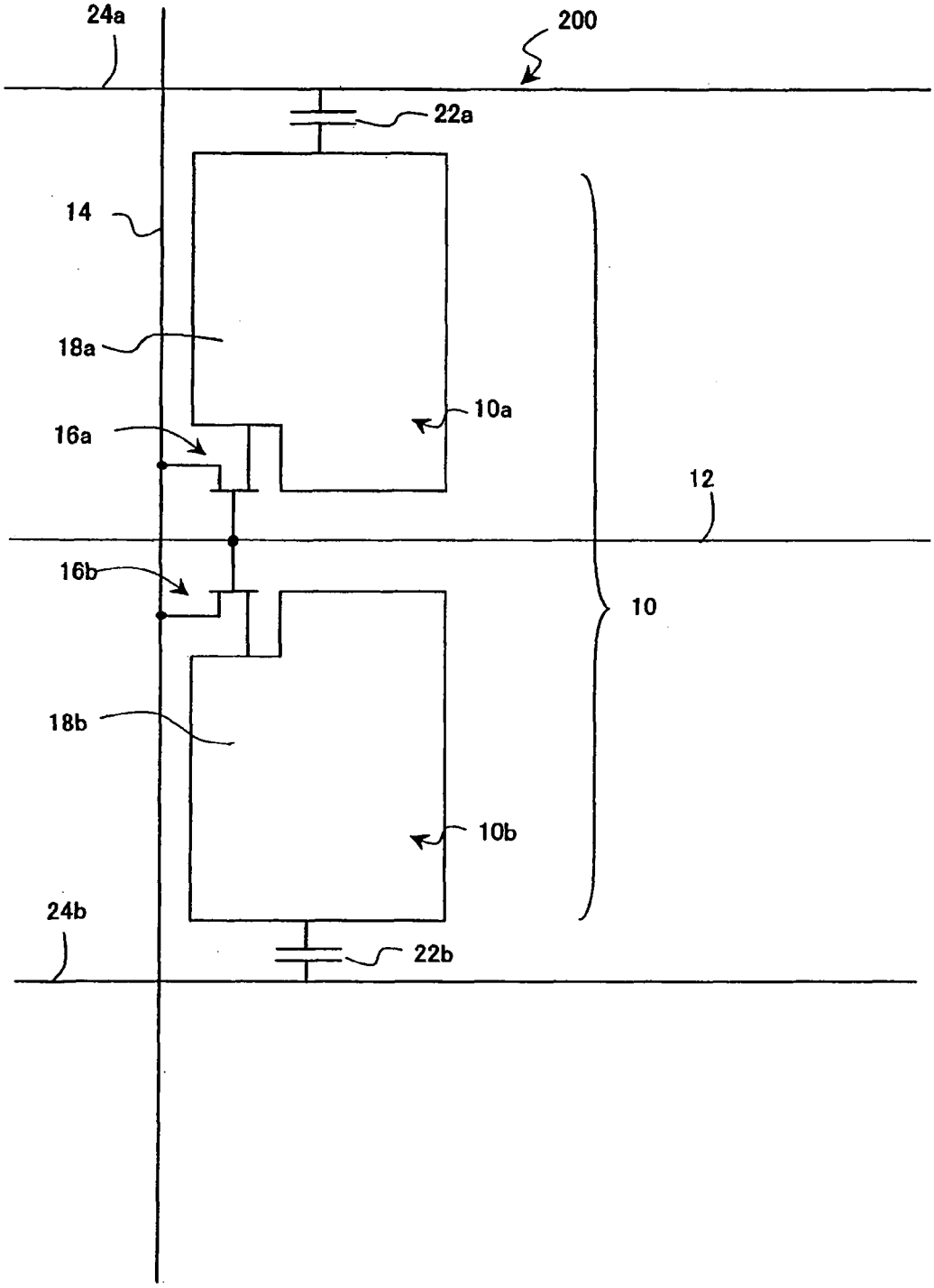
FIG. 18 schematically illustrates the pixel division structure of the liquid crystal display device 200 disclosed in Patent Document No. 3.
Figure 19:
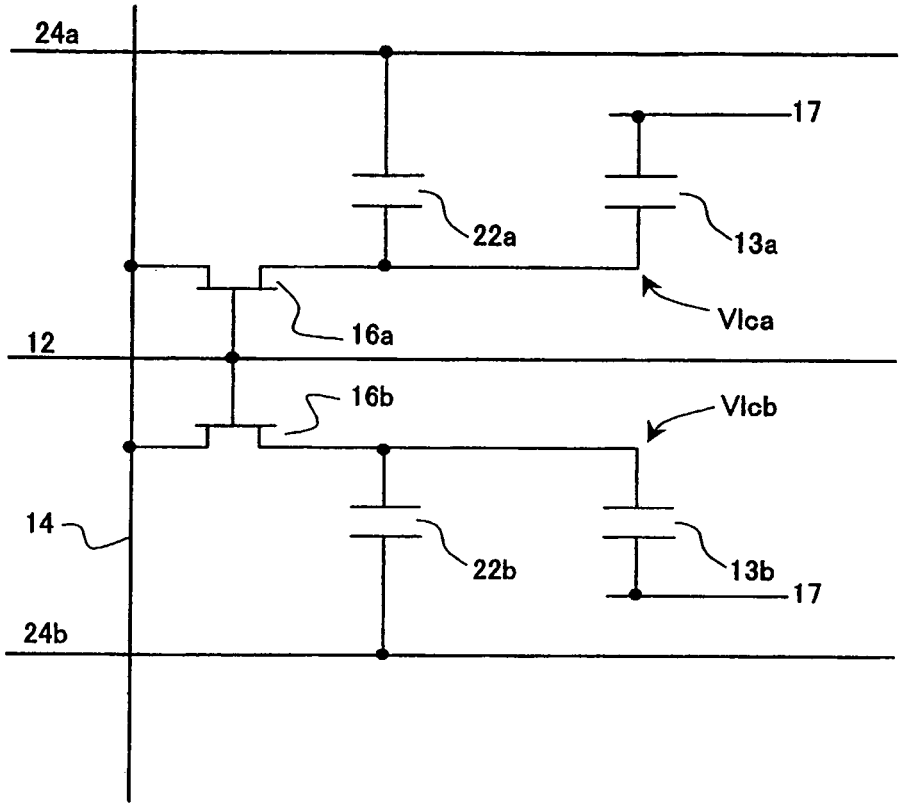
FIG. 19 illustrates an electrically equivalent circuit corresponding to the pixel structure of the liquid crystal display device 200.
Figure 20:
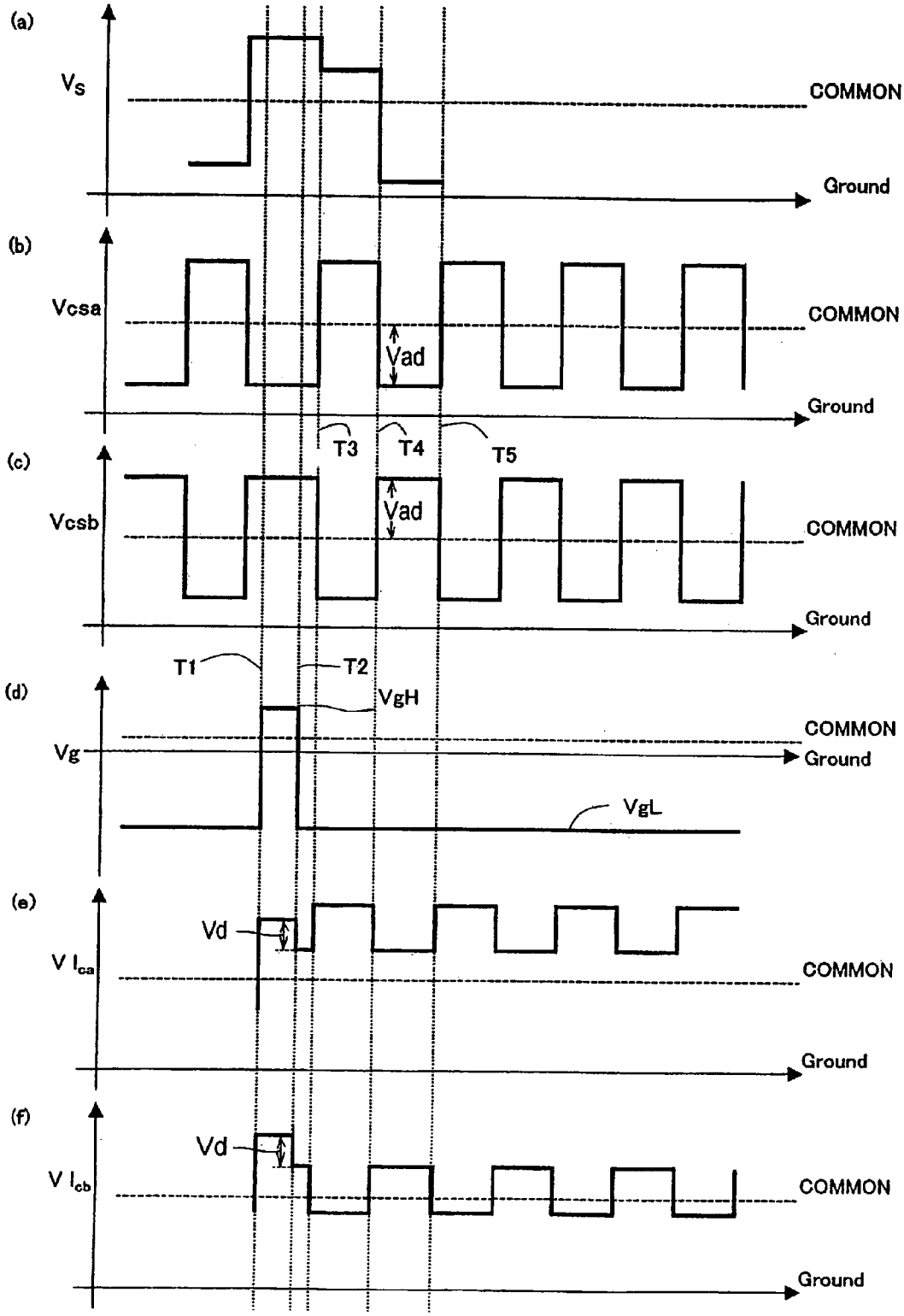
FIGS. 20 (*a*)-(*f*) illustrate the waveforms of various types of voltages applied to drive the liquid crystal display device 200.
Figure 21:
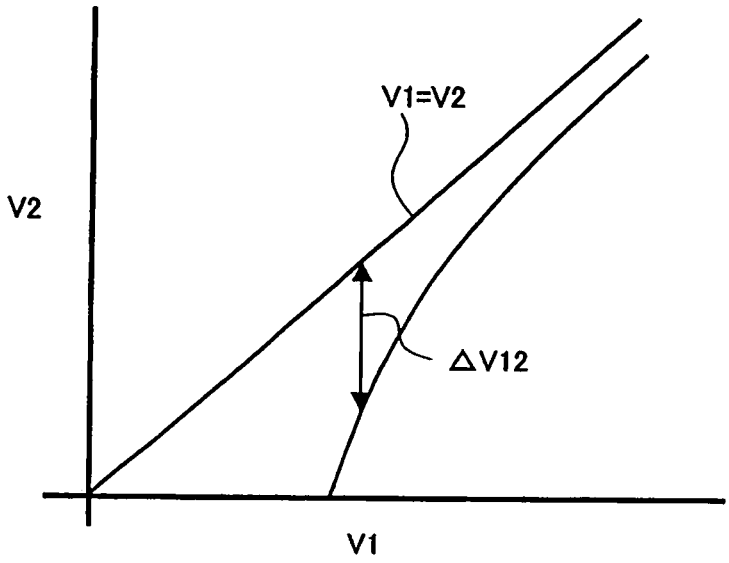
FIG. 21 shows how the voltages applied to the liquid crystal layer between the subpixels change in the liquid crystal display device 200.

Hereinafter, it will be described with reference to portions (a) through (d) of FIG. 17 how the liquid crystal display device 100 operates. Portions (a) through (d) of FIG. 17 schematically show the waveforms of the respective signals in the liquid crystal display device 100. In FIG. 17, VSdc represents the DC level of the data signal voltage S(i) and may be generally regarded as being equal to the counter electrode potential Vcom.

As shown in portion (a) of FIG. 17, the source driver 70 generates an analog signal voltage d(i), of which the polarity inverts every horizontal scanning period (1H). In the liquid crystal display device of this preferred embodiment, the length of one horizontal scanning period is not always constant, but one vertical scanning period includes a period in which one horizontal scanning period has a length of 1Ho (which is as long as one horizontal scanning period 1H of the video data of the original input video signal) as a regular period and a period in which one horizontal scanning period has a length of 1Hn, longer than 1Ho, as an adjustment period as described above. In the following example, however, these Ho and Hn periods will not be distinguished from each other but will be collectively referred to herein as 1H to describe the CSI driving method.

The display controller 60 generates the short-circuit control signal Csh shown in portion (b) of FIG. 17. The short-circuit control signal Csh goes high for just a short predetermined period of time Tsh (which is typically as short as one horizontal scanning period) including a point in time when the polarity of each analog signal voltage d(i) inverts. Such a short period in which Tsh goes high will be referred to herein as either a "short-circuit period" or a "charge sharing period". As already described with reference to FIG. 16, when the short-circuit control signal Csh is low, the data signal voltages S(i), generated by performing an impedance transformation on each analog signal, are output to the source bus lines. On the other hand, when Csh is high, each pair of adjacent source bus lines is short-circuited together. Since the dot inversion drive is carried out on this liquid crystal display device 100, the voltages supplied to each pair of adjacent source bus lines have mutually opposite polarities but approximately equal absolute values (because the data represented by adjacent pixels has a high degree of correlation). That is why if each pair of adjacent source bus lines is short-circuited together, the voltage on the source bus lines SL1, SL2, . . . and SLm will become substantially equal to the DC level VSdc of the data signal voltage S(i). That is to say, the potential on the source bus lines SL1, SL2, . . . and SLm becomes almost equal to the counter electrode potential Vcom and almost no voltage is applied to the liquid crystal layer of any pixel. In other words, substantially a black voltage (or at least a voltage equal to or lower than the threshold voltage) is applied to liquid crystal layer. As a result, the black write operation can get done virtually.

Strictly speaking, the voltage waveform identified by S(i) in portion (c) of FIG. 17 is not the data signal voltage S(i) supplied from the buffer 31 but a potential on the source bus line to which S(i) is supplied. That is to say, the waveform shown in portion (c) of FIG. 17 is the data signal voltage S(i) except the short-circuit periods Tsh but represents the DC level VSdc of the data signal voltage (which is approximately equal to the counter electrode potential Vcom) in the short-circuit periods Ts. To substantially equalize the voltage on each source bus line with either VSdc or Vcom by short-circuiting together each pair of adjacent source bus lines when the data signal voltage S(i) inverts its polarity, the configuration of this preferred embodiment does not always have to be used but any of other known configurations disclosed in Japanese Patent Applications Laid-Open Publications Nos. 9-212137, 9-243998 and 11-30975, for example, may also be used.

To write the respective data signal voltages S(1), S(2), . . . and S(m) onto the respective pixels at predetermined timings (i.e., to charge the pixel capacitors), the gate driver 80 sequentially selects one of the gate bus lines GL1, GL2, . . . and GLn after another for substantially one horizontal scanning period (1H) each in every frame period (i.e., every vertical scanning period V shown in FIG. 17) of the digital image signal DA and also selects the gate bus line GLj (where j=1, 2, . . . and n) at least once for just a short predetermined period of time Tsh when the data signal voltage S(i) inverts its polarity to perform the black insert operation to be described later. That is to say, as shown in portions (d) and (e) of FIG. 17, the gate driver 80 applies a scan signal voltage G(j), including an image data write pulse Pw and a black voltage application pulse Pb, to that gate bus line GLj.

TFTs that are connected to the gate bus line, to which the image data write pulse Pw and the black voltage application pulse Pb are applied, are turned ON. Such a state will be sometimes referred to herein as a state in which "the gate bus line is selected". Naturally, a gate bus line, connected to TFTs in OFF state, is in a non-selected state. In this case, the image data write pulse Pw remains high for an effective scanning period corresponding to the effective display period within one horizontal scanning period (1H), but the black voltage application pulse Pb goes high for just the short-circuit period Tsh corresponding to the horizontal retrace interval (or horizontal blanking interval) within one horizontal scanning period (1H). In this example, in each scan signal voltage G(j), the interval between the image data write pulse Pw and the first black voltage application pulse Pb that appears earlier than any other black voltage application pulse after the image data write pulse Pw has been applied is two-thirds of one frame period ((⅔)×V) and three black voltage application pulses Pb appear at a regular interval of one horizontal scanning period (1H) in one frame period.

Next, it will be described with reference to portion (f) of FIG. 17 how the luminance of the pixel located at the intersection between the $j^{th}$ row and $i^{th}$ column of the liquid crystal display device 100 varies.

When the image data write pulse Pw is applied to the gate bus line GLj as shown in portion (d) of FIG. 17, the pixel (j, i) is charged with the image data signal voltage S(i) that is supplied to the source bus line SLi shown in portion (c) of FIG. 17. In this case, the pixel is gradually charged according to the chargeability of the pixel capacitor (including a liquid crystal capacitor and a storage capacitor) and then retains the charge stored there. As the voltage being applied to the pixel capacitor rises, the liquid crystal molecules gradually change their orientations, thus increasing the luminance. Since the pixel capacitor is electrically cut off from the source bus line SLi once the image data write pulse Pw has been turned OFF, a luminance corresponding to the image data signal voltage S(i) is retained over a period Thd of time (which will be referred to herein as an "image data retention period") until the black voltage application pulse Pb is applied.

Next, when the black voltage application pulse Pb is applied during a period Tsh in which the short-circuit control signal Csh is high (which will be referred to herein as a "short-circuit period"), the pixel capacitor gets connected to the source bus line SLi that has had a potential VSdc by that time as shown in portion (b) of FIG. 17. As a result, the voltage applied to the pixel capacitor decreases and the luminance decreases, too. In the same way, when the black voltage application pulse Pb is applied for the second time, the voltage applied to the pixel capacitor goes zero, thus producing a black display state.

Thereafter, through a period Tbk (black display period) until the next image data write pulse Pw is applied to the gate bus line GLj, the black display state is maintained. By inserting the black display period Tbk into each frame in this manner, a display operation of a hold-type liquid crystal display device can be a pseudo-impulse type.

As can be seen from portions (d) and (e) of FIG. 17, the leading edge of the image data write pulse Pw shifts by one horizontal scanning period (1H) every time the scan signal voltage G(j) is applied. That is why the leading edge of the black voltage application pulse Pb also shifts by one horizontal scanning period (1H) every time the scan signal voltage G(j) is applied. As a result, a black display period of the same length is inserted into every display line. In this manner, a black display period of a sufficient length can be inserted without shortening the time for writing image data (i.e., the pixel charge period). On top of that, there is no need to increase the operating rate of the source driver 70, for example, to get the black insert operation done. In this example, black voltage application pulses Pb are supposed to be applied three times in a single vertical scanning period. However, the present invention is in no way limited to this specific example. Alternatively, the black voltage application pulse may also be applied any other number of times as long as the pulse is applied at least once. Also, even if the pulses are applied a number of times, not all of those pulses need to be applied continuously.

It should be noted that the black insert drive does not have to be performed by the method just described but may be carried out by any other known technique (such as the methods disclosed in Japanese Patent Applications Laid-Open Publications Nos. 2000-105575 and 2001-265287). Also, in the example described above, a black insert driving method is supposed to be adopted as a driving method for writing data in a vertical blanking interval. However, the present invention is in no way limited to that specific preferred embodiment. The entire disclosure of the two publications cited above is hereby incorporated by reference.

In the foregoing description, a normal a situation where one horizontal scanning period of an input video signal is as long as one horizontal scanning period for writing image data on a display panel has been described as an example. According to a special driving method for changing the timings to drive using a frame memory, for example, not one horizontal scanning period of the input video signal but a standard horizontal scanning period for writing image data on the display panel may be defined as 1H. The standard horizontal scanning period is either defined in advance according to the use of the display device or determined based on one horizontal scanning period of the input video signal. Thus, one horizontal scanning period of the input video signal in the foregoing description may be replaced with the standard horizontal scanning period as it is.

In the foregoing description of preferred embodiments, the present invention has been described as being applied to a liquid crystal display device. However, this technique for adjusting the number of horizontal scanning periods included in one vertical scanning period by partially using 1Hn, which is different from one horizontal scanning period (1H) of an input video signal, as one horizontal scanning period for a display panel does not have to be used in a liquid crystal display device but is broadly applicable to any other type of display device to be driven line-sequentially.

Industrial Applicability

The present invention can be used effectively in a liquid crystal display device for a TV receiver with a big screen size of 30 inches or more, for example.

The invention claimed is:

1. A display device comprising:

a display panel with multiple pixels; and a display controller that receives an input video signal and a sync signal and gets an image presented on the display panel, wherein if one horizontal scanning period and one vertical scanning period of the input video signal are represented by 1H and V-Total, respectively, the display controller is configured to form one vertical scanning period V-Total of a first period in which one horizontal scanning period of the display panel is 1Ho, which is as long as 1H, and a second period in which one horizontal scanning period of the display panel is 1Hn, which is not as long as 1H, the second period is a number of continuous horizontal scanning periods each having a length of 1Hn, wherein the pixels are arranged in columns and rows so as to form a matrix pattern, each said pixel including, a first subpixel and a second subpixel, having liquid crystal layers to which mutually different voltages are applicable, a plurality of electrodes for applying the mutually different voltages to the liquid crystal layers, and two switching elements that are provided for the first and second subpixels, respectively, and each of the first and second subpixels includes, a liquid crystal capacitor formed by a counter electrode and a subpixel electrode that faces the counter electrode through the liquid crystal layer, and a storage capacitor formed by a storage capacitor electrode that is electrically connected to the subpixel electrode, an insulating layer, and a storage capacitor counter electrode that is opposed to the storage capacitor electrode with the insulating layer interposed between them, and wherein the counter electrode is a single electrode provided in common for the first and second subpixels, while the storage capacitor counter electrodes of the first and second subpixels are electrically independent of each other, and a storage capacitor counter voltage applied to each said storage capacitor counter electrode by way of an associated storage capacitor line oscillates in a cycle time that is an integer number of times as long as Ho during the first period included in V-Total but oscillates in a cycle time that is an integer number of times as long as Hn during the second period, when one vertical scanning period V-Total is represented as the sum of an effective display period V-Disp and a vertical blanking interval V-Blank and V-Total=m×H and V-Disp=$m_0$×H, then V-Disp=$m_0$×Ho, V-Blank=$m_1$×Ho+$m_2$×Hn, m, $m_0$, $m_1$ and $m_2$ being positive integers, and $m_2$×Hn is an integer number of times as long as one cycle time of the storage capacitor counter voltage during the second period.

2. A display device comprising:

a display panel with multiple pixels; and a display controller that receives an input video signal and a sync signal and gets an image presented on the display panel, wherein if one standard horizontal scanning period and one vertical scanning period to write image data on the display panel are represented by 1H and V-Total, respectively, the display controller is configured to form one vertical scanning period V-Total of a first period in which one horizontal scanning period of the display panel is 1Ho, which is as long as 1H, and a second period in which one horizontal scanning period of the display panel is 1Hn, which is not as long as 1H, the second period is a number of continuous horizontal scanning periods each having a length of 1Hn, wherein the pixels are arranged in columns and rows so as to form a matrix pattern, each said pixel including, a first subpixel and a second subpixel, having liquid crystal layers to which mutually different voltages are applicable, and a plurality of electrodes for applying the mutually different voltages to the liquid crystal layers, two switching elements that are provided for the first and second subpixels, respectively, and each of the first and second subpixels includes, a liquid crystal capacitor formed by a counter electrode and a subpixel electrode that faces the counter electrode through the liquid crystal layer, and a storage capacitor formed by a storage capacitor electrode that is electrically connected to the subpixel electrode, an insulating layer, and a storage capacitor counter electrode that is opposed to the storage capacitor electrode with the insulating layer interposed between them, and wherein the counter electrode is a single electrode provided in common for the first and second subpixels, while the storage capacitor counter electrodes of the first and second subpixels are electrically independent of each other, and a storage capacitor counter voltage applied to each said storage capacitor counter electrode by way of an associated storage capacitor line oscillates in a cycle time that is an integer number of times as long as Ho during the first period included in V-Total but oscillates in a cycle time that is an integer number of times as long as Hn during the second period, wherein when one vertical scanning period V-Total is represented as the sum of an effective display period V-Disp and a vertical blanking interval V-Blank and V-Total=mxH and V-Disp=$m_0$×H, then V-Disp=$m_0$×Ho, V-Blank=$m_1$×Ho+$m_2$×Hn, m, $m_0$, $m_1$ and $m_2$ being positive integers, and m2xHn is an integer number of times as long as one cycle time of the storage capacitor counter voltage during the second period.

3. The display device of claim 1, wherein V-total is represented as the sum of an effective display period V-Disp and a vertical blanking interval V-Blank and wherein the second period is included in the vertical blanking interval V-Blank.

4. The display device of claim 1, wherein $(m_{0+m1})\times Ho$ is one of an integer and a half-integer number of times as long as one cycle time of the storage capacitor counter voltage during the first period, $m_0$ and $m_1$ being positive integers.

5. The display device of claim 1, further comprising a plurality of storage capacitor trunks, which are electrically independent of each other and each of which is electrically connected to an associated one of the storage capacitor counter electrodes of the first and second subpixels of the pixels by way of its associated storage capacitor line, wherein the storage capacitor trunks include an even number L of electrically independent storage capacitor trunks, and the storage capacitor counter voltage supplied through each of the storage capacitor trunks to its associated storage capacitor line oscillates in a cycle time that is one of K×L and 2×K×L times as long as Ho during the first period, where K is a positive integer and one of K×L and 2×K×L is equal to or greater than four, and oscillates in a cycle time that is one of K×L and 2×K×L times as long as Hn during the second period.

6. The display device of claim 2, wherein V-total is represented as the sum of an effective display period V-Disp and a vertical blanking interval V-Blank and wherein the second period is included in the vertical blanking interval V-Blank.

7. The display device of claim 2, wherein $(m_{0+m1})\times Ho$ is one of an integer and a half-integer number of times as long as one cycle time of the storage capacitor counter voltage during the first period, $m_0$ and $m_1$ being positive integers.

8. The display device of claim 2, further comprising a plurality of storage capacitor trunks, which are electrically independent of each other and each of which is electrically connected to an associated one of the storage capacitor counter electrodes of the first and second subpixels of the pixels by way of its associated storage capacitor line, wherein the storage capacitor trunks include an even number L of electrically independent storage capacitor trunks, and the storage capacitor counter voltage supplied through each of the storage capacitor trunks to its associated storage capacitor line oscillates in a cycle time that is one of K×L and 2×K×L times as long as Ho during the first period, where K is a positive integer and one of K×L and 2×K×L is equal to or greater than four, and oscillates in a cycle time that is one of K×L and 2×K×L times as long as Hn during the second period.

* * * * *